US012584286B2

(12) United States Patent
Brindle et al.

(10) Patent No.: US 12,584,286 B2
(45) Date of Patent: Mar. 24, 2026

(54) MATERIAL HANDLING MACHINE

(71) Applicant: J. C. Bamford Excavators Limited, Uttoxeter (GB)

(72) Inventors: Richard Brindle, Uttoxeter (GB); Paul Walsham, Uttoxeter (GB); Jack Nash, Uttoxeter (GB); Colin Goddard, Uttoxeter (GB); Robin Scotchford, Uttoxeter (GB); David Craig Panni, Uttoxeter (GB); Michael Boyd Richardson, Uttoxeter (GB); Paula Langley, Uttoxeter (GB); Thomas Pritchard, Uttoxeter (GB); Christopher David Price, Uttoxeter (GB); Jonathan Kenred Bailey, Uttoxeter (GB); Sam de Berry, Uttoxeter (GB)

(73) Assignee: J.C. Bamford Excavators Limited, Uttoxeter (GB)

( * ) Notice: Subject to any disclaimer, the term of this patent is extended or adjusted under 35 U.S.C. 154(b) by 187 days.

(21) Appl. No.: 18/382,467

(22) Filed: Oct. 20, 2023

(65) Prior Publication Data

US 2024/0133149 A1 Apr. 25, 2024
US 2024/0229411 A9 Jul. 11, 2024

(30) Foreign Application Priority Data

Oct. 20, 2022 (GB) ..... 2215539

(51) Int. Cl.
*E02F 3/28* (2006.01)
*E02F 9/16* (2006.01)
*E02F 9/22* (2006.01)

(52) U.S. Cl.
CPC ..... *E02F 3/286* (2013.01); *E02F 9/2296* (2013.01); *E02F 9/16* (2013.01)

(58) Field of Classification Search
CPC . E02F 3/286; E02F 9/2296; E02F 9/16; E02F 9/0866; E02F 9/2271;
(Continued)

(56) References Cited

U.S. PATENT DOCUMENTS 4,755,102 A * 7/1988 Merlo ..... B66F 9/122 414/692
5,199,861 A * 4/1993 Merlo ..... B66F 9/0655 414/718
(Continued)

FOREIGN PATENT DOCUMENTS

EP 0692448 A1 1/1996
EP 0945396 A2 9/1999
(Continued)

OTHER PUBLICATIONS

Translation of GB-2336141-A; Jul. 25, 2024.*
(Continued)

*Primary Examiner* — Paul N Dickson
*Assistant Examiner* — Shams Dhanani
(74) *Attorney, Agent, or Firm* — MARSHALL, GERSTEIN & BORUN LLP

(57) ABSTRACT

A trailer towable compact telehandler having an operator cab with an internal width greater than 700 mm and a curbside weight less than 2950 kg. Also included is a telehandler having a side-mounted engine which extends through a side wall of the chassis and under a lifting arm of the telehandler. Also included is a compact tool carrier having a reduced fore-aft dimension between an attachment plane and a principal pivot member.

20 Claims, 17 Drawing Sheets

(58) Field of Classification Search
CPC ..... B60K 2015/03414; B60Y 2200/22; B66F 9/07513; B66F 9/07572; B66F 9/065; B66F 9/0655; B66F 9/0759
See application file for complete search history.

(56) References Cited

U.S. PATENT DOCUMENTS

| | | | | |
|---|---|---|---|---|
| 6,382,899 | B1 * | 5/2002 | Cook | B60K 17/00 180/374 |
| 10,718,098 | B1 * | 7/2020 | Hager | E02F 9/2004 |
| 11,518,660 | B1 * | 12/2022 | Higgins, Sr. | B66F 9/16 |
| 2002/0001516 | A1 * | 1/2002 | Cook | B66F 9/0655 414/685 |
| 2002/0079109 | A1 * | 6/2002 | Contoli | E02F 3/433 172/8 |
| 2003/0150663 | A1 * | 8/2003 | Farbotnik | F16F 1/54 180/312 |
| 2003/0152454 | A1 * | 8/2003 | Albright | E02F 3/286 414/728 |
| 2004/0148822 | A1 * | 8/2004 | Albright | E02F 3/3414 37/466 |
| 2018/0127950 | A1 * | 5/2018 | Kukuk | E02F 3/4133 |
| 2019/0031479 | A1 * | 1/2019 | Delzenne | B66F 9/0655 |
| 2024/0083728 | A1 * | 3/2024 | Merlo | B66F 9/07581 |
| 2024/0102263 | A1 * | 3/2024 | Hamamoto | E02F 9/2033 |
| 2024/0132163 | A1 * | 4/2024 | Leon | E02F 9/163 |
| 2024/0337092 | A1 * | 10/2024 | Hamamoto | F15B 19/00 |
| 2024/0383733 | A1 * | 11/2024 | Gabillard | B66F 9/07581 |
| 2024/0417226 | A1 * | 12/2024 | Derval | B66F 9/0655 |

FOREIGN PATENT DOCUMENTS

| | | | |
|---|---|---|---|
| EP | 0949187 | A2 | 10/1999 |
| EP | 3718952 | A1 | 10/2020 |
| GB | 2336141 | A | 10/1999 |
| IT | 201900010098 | A1 | 12/2020 |

OTHER PUBLICATIONS

Extended European Search Report for EP 23205038.5, dated Mar. 27, 2024.
Search Report issued in GB2215539.4, dated Apr. 3, 2023.
Examination Report, GB Application No. 23205038.5, dated Dec. 15, 2025.

* cited by examiner

MATERIAL HANDLING MACHINE

FIELD

This invention relates to a material handling machine having a pivoting telescopic working arm. In particular, this invention relates to a compact telehandler.

BACKGROUND

Telehandlers are generally well known and comprise a work machine with a pivoting telescopically extending lifting arm which allows items to be transported between different locations at varying heights with relative ease and flexibility. Telehandlers are often utilized in agriculture, construction or logistics, amongst other sectors.

Telehandlers are often described in relation to their maximum lifting load and the vertical height a load can be lifted to. Typically, loads and the lifting height will vary depending on the type of machine and industry in which it is used. For example, a compact telehandler may be rated to lift around 1400 kg to a vertical height of 4 m, with a larger agricultural machine lifting around 6000 kg to a vertical height of 8 m. However, a large range of rated loads and lifting heights are possible with some machines being configured to lift to 20 m or higher and greater weights.

Another type of material handling machine are known as rotating telehandlers or roto-telehandlers or simply "rotas". These machines are configured to slew about a main vertical axis such that a main body which carries the working arm is able to rotate with respect to a ground engaging structure and chassis. Such machines are generally larger than conventional telehandlers and can handle larger loads at extended heights, e.g. in excess of 5000 kg to heights above 20 m, although this is not a limitation and compact roto-telehandlers which lift smaller loads to lower heights exist. Roto-telehandlers are typically used when stationary but this is not a limitation.

Other material handling machines include so-called skid steers which may also be equipped with a telescopic arm. Skid steers generally comprise a compact rigid frame with fixed wheels or tracks which do not pivot relative to the body to effect steering. The respective wheels or tracks on each side of the machine are driven in unison and have independent speed control relative to the other side such that changing the relative speed results in a change in direction. Skid steers generally have limited lifting capacity and height due to the compact nature of the machine.

A yet further type of material handling machine is a wheeled loading shovel which may also be provided with a telescopically extending shovel arm. Generally, wheeled loading shovels are characterized by an articulating chassis to effect steering. These machines are typically used with a shovel for loading large quantities of materials into a transportation vehicle or around a location and have limited extension.

Hence, telehandlers of the type this disclosure is concerned with may be differentiated over other types of material handling machine by having steerable wheels which move relative to the chassis, either in two wheel or four-wheel steering modes, and comprise a pivoting working arm or boom which is provided in a fixed relation to the chassis and ground engaging structure. Telehandlers may also be characterized by their lift capacity and height, which may generally be taken to be above 1200 kg and 3 m respectively.

Within telehandlers, it is commonplace to refer to the smaller machines as compact telehandlers. These machines have relatively large lifting capacity in terms of height and load but are sufficiently compact to offer improved access and, in some instances, a weight which allows towing on a conventional braked trailer with a combined machine and trailer weight of 3500 kg, this being a legislative limit in some countries and required for CE certification in Europe. In order to account for the trailer weight, it is an aim for compact telehandlers to have a weight between 2.5 T and 2.95 T. An ideal weight may be considered to be around 2.7 T. The external width of a compact telehandler would typically be at or under 1.6 m to suit access requirements on typical worksites where a compact may be utilized.

Compact telehandlers exist in the market but, due to the desire to have a restricted width and weight, typically have a reduced cab width when compared to their larger counterparts. This can make working conditions for operators more restricted which in turn can lead to operator fatigue across a working shift. Fatigue may lead to a lack of efficiency and attentiveness which, in turn, may lead to mistakes and reduced safety.

A further disadvantage of many compact telehandlers is the location of the engine. In order to keep the size of the machine below a prescribed width, it is commonplace to provide the engine at the rear of the machine, simply because there is insufficient room to side mount the engine as is the case in many larger machines. Where compact telehandlers do have side mounted engines, it requires the working arm to be located more centrally with respect to the machine chassis, which in turn reduces the width of the cab.

Working machines are typically diesel-powered. However, there is a drive in the industry to move towards hybrid, electric or hydrogen powered vehicles, particularly where such vehicles are used indoors. One difficulty with this is removal of the diesel engine, since this significantly alters the weight distribution of the machine and has implications for the stability of the working machine.

Re-designing the working machine to be powered by an electric motor or motors rather than by a diesel engine can also lead to a requirement for investment in new infrastructure such as assembly lines, and reduced efficiency of assembly and maintenance operations due to the different layout of an electrically-powered machine. Other factors such as cooling must also be taken into consideration. In a compact machine, installation of components can be difficult due to restricted space envelopes.

The present invention seeks to provide an improved compact telehandler.

SUMMARY

The present invention provides a material handling machine according to the appended claims.

According to a first aspect of the present disclosure, there is provided a material handling machine, e.g. a telehandler. The material handling machine may comprise a front and a rear defined by the principal direction of travel. The machine may have a cab side and a lifting arm side located on either side of a fore-aft centerline of the machine.

The machine may be trailer towable. A trailer towable machine will typically be less than 7 m in length, 2.55 m in width and have a combined machine and trailer weight of less than 3500 kg. A typical trailer weight would typically range from between 550 kg and 850 kg.

The machine may comprise a body. The body may comprise a rigid chassis. The body may be mounted on a ground engaging structure in a fixed orientation. The ground engaging structure may be configured to provide tractive effort to propel the machine overground. The ground engaging structure may comprise a pair of front wheels and a pair of rear wheels. At least one of the pairs of wheels may be selectively orientated relative to the body (that is, pivoted about a substantially vertical axis) to effect steering of the machine.

The machine may comprise a prime mover operable to drive the front and/or rear wheels.

The machine may comprise a lifting arm which may be pivotally mounted towards an aft end of the body. The lifting arm may be a single lifting arm, that is, the only lifting arm provided on the machine. The lifting arm may be telescopic. The lifting arm may be provided within a lifting arm housing comprising first and second sidewalls and a base wall.

The machine may comprise an operator cab mounted to the body on a cab side and adjacent to the lifting arm. The operator cab may comprise a seat and one or more control devices for controlling the ground engaging structure and/or an operation of the lifting arm.

The operator cab may extend from the cab side of the machine across a width of the machine. The operator cab may define the width of the machine on the cab side.

The operator cab may further comprise a first cab sidewall and a second cab sidewall. The first cab sidewall may be provided on the cab side of the machine, the second cab sidewall may be provided on an inboard side and adjacent to the lifting arm. The second cab sidewall may be provided on the lifting arm side of the machine centerline.

The first and second cab sidewalls may define an internal width of the operator cab. The internal width may be defined between the internal surfaces of one or more windows provided as part of the sidewalls. The internal width may be measured at a height which corresponds to the center of steering wheel and/or the height of a joystick configured to operate the lifting arm.

The internal width may be greater than 700 mm, optionally greater than 750 mm, optionally greater than 800 mm, optionally greater than 850 mm.

The external width of the cab may be greater than 775 mm, optionally greater than 850 mm, optionally greater than 900 mm, optionally greater than 950 mm.

The weight of the machine may be between 2500 kg and 2950 kg. Optionally, the weight may be between 2600 kg and 2800 kg or between 2650 kg and 2750 kg, or approximately 2700 kg. The weight of the machine may exclude a lifting implement attached to the lifting arm. The weight of the implement may be between 100 kg and 200 kg, for example. Where the lifting implement is attached, the weight may be between 2600 kg and 2950 kg. The operating weight, e.g. with a driver, will be greater than the towing weight.

The first cab sidewall may define the external width of the machine on the cab side. The second cab sidewall may be located on an opposite side of a centerline such that the cab extends over at least half of the width of the machine.

The width of the machine may be less than 1600 mm, optionally less than 1550 mm, optionally equal to or less than 1500 mm. In some embodiments, the width of the machine may be greater than 1450 mm.

The machine may comprise a tool carrier or carriage mounted to a distal end of the lifting arm. The tool carrier may be configured to engage with or attach to a tool. The carriage may comprise a tool.

The length of the machine may be equal to or less than 3000 mm, optionally less than 3250 mm, optionally less than 3500 mm. The length of a trailer on which the machine may be towed may be 7 m, minus the A frame.

The length of the machine may be measured from the foremost tip of the tool carrier or carriage to the rearmost part of the machine. The rear most part may be defined by the body or ground engaging structure. In some embodiments, the rear of the machine may be defined by a safety strut which is attached at the rearmost location of the body. The body may comprise a counterweight. The counterweight may provide the rearmost part of the machine.

The operator cab may be axially located fully between the front wheels and the rear wheels on the cab side of the machine, with respect to the longitudinal axis. The cab may be located fully between the wheel tires. The cab may be located fully between the front and rear axles.

The length of the cab may be between 1200 mm and 1600 mm, optionally, between 1300 mm and 1450 mm. The length of the cab may be defined between the foremost and rearmost extremes of the cab interior. The length of the cab may be defined by fore and aft cab mounts.

The height of the cab may be between 1200 mm and 1800 mm, optionally between 1300 mm and 1700 mm, optionally between 1400 mm and 1600 mm. The height of the cab may be measured from the internal floor to the inner surface of the roof lining.

The lifting arm may be configured to lift a weight to a height greater than 3.5 m, optionally greater than 4 m, optionally greater than 4.5 m. The lift height may be less than 5 m, optionally less than 4.5 m, optionally less than 4 m.

The maximum lift weight to the maximum lift height may be greater than 1200 kg, optionally greater than 1300 kg, optionally greater than 1400 kg, optionally greater than 1500 kg. The maximum lift weight may be less than 1600 kg, optionally less than 1500 kg.

The lifting arm housing may be located fully on lifting arm side of the centerline of the machine. The first sidewall may be referred to as a lifting arm side sidewall. The second sidewall may be referred to as a cab side sidewall. The cab side sidewall may be located on the centerline or on the lifting arm side of the centerline.

The machine may comprise a prime mover. The prime mover may form part of a power train for providing propulsive power to the ground engaging structure. The prime mover being side mounted on an opposing side of the cab. The prime mover may comprise an engine. The engine may be a gas engine or conventional internal combustion engine configured to run on gasoline or diesel. The gas engine may be configured to run on a gaseous fuel such as hydrogen or compressed natural gas, amongst others.

The prime mover may be fully located on the lifting side of the centerline. The prime mover may, with respect to the longitudinal axis, be axially located between the front and rear wheels on the lifting arm side. The longitudinal extent of the prime mover may be contained between the front and rear wheels, optionally between the front and rear tires, optionally between the front and rear axles.

The cab, lifting arm and prime mover may be located along a width-wise centerline of the machine. That is, the cab, lifting arm and prime mover may be located on a midline of the machine.

The prime mover may extend through the first sidewall of the lifting arm housing. The prime mover may extend under the lifting arm. One or more taken from the group comprising: the crankcase; cylinders; cylinder head; a radiator, radiator fan; radiator fan housing; fuel filter; air filter; electrical generator; exhaust manifold; exhaust diesel particulate filter; exhaust muffler; and, a fuel cooling radiator may be wholly or partially located within the lifting arm housing and/or under the lifting arm.

The prime mover and base wall of the lifting arm housing may be provided at a common height. The base wall may extend around the prime mover. The base wall may extend from an aft location of the prime mover on the first sidewall to a fore location on the second sidewall of the lifting arm housing. The fore location may be forward of the prime mover. The aft location may be fully aft and/or at an axial midportion of the prime mover with respect to the longitudinal axis of the machine.

The prime mover may extend through an aperture in the first sidewall of the lifting arm housing. The aperture through which the prime mover extends may comprise a lobed profiled in which a plurality of lobes are provided to receive parts of the prime mover. The aperture may comprise a plurality of apertures, each aperture receiving one or more components of the prime mover.

A first lobe may extend around a first component of the prime mover or a transmission system. A second lobe may extend around a component of the prime mover or a transmission system. The first lobe may comprise, for example, an exhaust muffler of the engine or an alternator. The second lobe may comprise, for example, one or more components of the hydraulic transmission such as a pump, a hydraulic hose or a gearbox.

The base wall may attach to the first sidewall on a projection which extends between and defines two of the plurality of lobes. The projection may extend forward from an aft portion of the aperture. The projection may lie in the plane of the sidewall. The projection may extend horizontally. The two lobes defined by the projection may comprise a first lobe and a second lobe. The first and second lobes may be located one above the other.

The base wall may comprise a lift actuator recess/cut-out for receiving a lift actuator for the lifting arm. The lift actuator may be elongate and extend forward from an aft connection with the chassis to a connection on the underside of the lifting arm. The lift actuator may comprise a hydraulic cylinder. The lift actuator recess may be provided towards the rear of the base wall. The lift actuator recess may extend forward of the aft-most edge of the base wall when viewed from above. The base wall may comprise a y-shape when viewed from above. The bowl of the y-shape may receive the lift actuator. The descender of the y-shape may extend around the prime mover.

The base wall may comprise a first elevated section and a second elevated section. The first and second elevated sections (which may be substantially horizontal and may be referred to as landings) may be located at different heights. The first elevated section may comprise an aft portion in which the lift actuator recess is received. The second elevation may be fore of the first elevation and may be lower than the first elevation. The first and second sections may be connected by a ramp.

A portion of the prime mover or transmission system may be located below the first elevation. A portion of the prime mover or transmission system may be located above the second elevation. The base wall may be arranged to extend around the prime mover. The base wall may be positioned to extend above components of the prime mover and/or components of the prime mover.

The machine may comprise a drive train. The drive train may comprise a hydrostatic drive. The hydrostatic drive may comprise a hydraulic pump and a hydraulic motor. The hydraulic pump and/or the hydraulic motor may be located beneath the base wall. The hydraulic motor may be located beneath the first elevated section.

The prime mover may be an electric motor.

The prime mover may be mounted to the body via a plurality of engine mounts. At least one engine mount may be provided outboard of the first sidewall of the lifting arm housing. At least one engine mount may be provided inboard of the first sidewall of the lifting arm housing.

The prime mover may be pivotable in relation to at least one of said engine mounts.

The prime mover may be pivotable in relation to an engine mount provided outboard of the first sidewall of the lifting arm housing.

The lifting arm housing may form part of a machine chassis. The machine chassis may have a front transverse section on to which a front axle and/or wheel assembly is mounted, and a rear transverse section onto which a rear axle and/or wheel assembly may be mounted. The front and rear transverse sections may extend fore and aft of the operator cab. The first and second sidewalls and base wall of the lifting arm housing may be attached to the front transverse section.

The first sidewall of the lifting arm housing may comprise a lifting arm side wheel assembly mount. The lifting arm side wheel assembly mount may comprise a main body which extends inwardly of the sidewall. The wheel assembly mount may be attached to an axle of the drive train. The attachment between the axle and the wheel assembly mount may be proximate the wheel assembly. The lifting arm side wheel assembly mount may comprise a recess to receive part of a wheel assembly. The recess may be provided in the first sidewall, optionally on an opposing side to the wheel assembly mount. The wheel assembly mount may be an axle mount proximate to the wheel assembly.

The wheel assembly mount may comprise a plate member. The cab side of the front transverse section of the chassis may comprise a corresponding wheel assembly mount. The cab side wheel assembly mount may extend outwardly with respect to the center of the machine.

The operator cab may be mounted on a plurality of cab mounts. The cab mounts may extend from the second sidewall and/or the front transverse section and/or rear transverse section.

The cab may be configured to provide structural supports for the chassis via the cab mounts. That is, the rigidity of the chassis under normal operating conditions may be at least partly dependent on the operator cab. As such, the cab mounts may be configured to carry a load of greater than 6000N, greater than 6500N, greater than 7000N or greater than 7200N. As such, the cab mounts are sufficiently rigid to allow the cab to provide structural rigidity without failing. In the case where the cab mounts for a machine of this size have a rigidity less than stated, the operating load experienced between the chassis and cab due to loading of the chassis and an associated deflection would result in the cab mount failing.

The cab may comprise at least one structural member which extends fore-aft and/or width-wise between a two or more cab mounts. The structural member may comprise a cab pillar located in a corner region of the cab and/or a roof panel. The cab mounts may comprise one or more reinforcements on an underside thereof. The cab mounts may comprise a plate, wherein a plurality of gussets may extend between the chassis and an underside of a cab mount plate.

In another aspect of the present disclosure, there may be provided the machine of the present disclosure on a trailer.

The trailer and machine may comprise a combined weight less than 3500 kg. The trailer may be a braked trailer.

In a further aspect of the present disclosure there is provided a material handling machine comprising: a body mounted on a ground engaging structure configured to propel the machine over ground and a single lifting arm having a distal end pivotally mounted towards an aft end of the body and a proximal end to which a tool carrier is mounted.

The tool carrier may comprise a coupling portion connected to the lifting arm and an attachment portion for receiving a work tool. The coupling portion may comprise a pivot member pivotally attached to lifting arm. The pivot member may define a pivot axis about which the tool carrier can pivot relative to the lifting arm.

The coupling portion may comprise a tilt mount attached to a tilt actuator of the lifting arm. The tilt actuator may be configured to rotate the tool carrier about the pivot axis.

The pivot member may extend for less than 60% of the width of the tool carrier, optionally for less than 55%, or less than 50%.

The coupling portion may extend from the outermost lateral edge on the lifting arm side of the tool carrier. The attachment portion may extend from the outermost lateral edge on the lifting arm side of the tool carrier. The coupling portion and attachment portion may be defined by at least one common lateral member.

The attachment portion may comprise first and second tool attachment members. The first and second tool attachment members may be configured to detachably receive a work tool. The second tool attachment member may comprise a reaction member configured to attach to and/or abut the work tool. The reaction member may be below the tool attachment member and prevent a rearward rotation of the work tool relative to the tool attachment member when loaded.

The first and second tool attachment members may define therebetween an attachment plane. The attachment plane may define the location of the tool member. The separation between the attachment plane and work tool pivot axis is less than 200 mm, optionally less than 130 mm.

The tool carrier may be configured to carry a load of at least 1.3 tons, optionally 1.4 tons.

The tool carrier may comprise first and second lateral members which define a width of the tool carrier. The width may be less than 900 mm, optionally less than 700 mm, optionally less than 650 mm.

The pivot member may extend between opposing lateral members including a first lateral member and an intermediate member. The intermediate member may be a central member which is located towards or at a midpoint of the tool carrier.

The tool carrier may comprise work tool pick-up points. The work tool pick-up points may be within the first lateral members and a second lateral member.

The tool carrier may comprise a torsion member extending between the first lateral member and central member. The torsion member may be located in a vertically lower position than the pivot member and reaction member when the tool carrier is in a vertical orientation. The vertical orientation may correspond to an orientation in which the reaction member is directly below the work tool attachment member.

The torsion member may be located vertically below the pivot axis. A plane extending between a center of the torsion member and the pivot axis may be parallel to the attachment plane.

The lifting arm and pivot member may be connected at a junction. The junction may be located between the first lateral member and central member. The junction may extend from the first lateral member towards the central lateral member. The junction may extend for less than half the width of the tool carrier, optionally for less than 40% of the width. The junction may comprise a welded joint.

Either or both of the first or second lateral members may terminate with a guide member for receiving and guiding a work tool on to the pick-up point. The guide members may form a funnel for receiving the outermost edges of the work tool pick-up points.

The first and second tool attachment members may extend between the first lateral member and second lateral member. The first and second tool attachment members may extend through the central member. A portion of the first and second tool attachment members which extends from the central member towards the second lateral member may be joined by a web. The web may comprise a curved or bent plate comprising an apex between the first and second tool attachment members and running parallel thereto.

The first and second attachment members, pivot member and optional torsion member may comprise elongate members having horizontal longitudinal axes.

The tool carrier may comprise a third lateral member inboard and adjacent to the second lateral member. The tool attachment member and reaction member may extend between the first lateral member and third lateral member, optionally through the third lateral member.

The tool carrier may comprise one or more guide members to aid location of a tool on the tool pick-up portions. The guide members may comprise funnel members. The funnel members may comprise a flared portion provided on the terminal end of any of the first, second and third lateral members. Guide members on the first and second lateral members may be inclined outwardly with respect to the center of the tool carrier. The guide member provided on the third lateral member may be inclined inwards towards the center of the tool carrier. The second and third lateral members may be separated by less than 60 mm or less, optionally, 40 mm or less. The angle of the guide members may be less than 90 degrees, optionally less than 80 degrees, optionally 70 degrees.

The cab side of the tool carrier may comprise a tool pick-up point having guide members on either side thereof. The guide members may form a funnel shape for receiving a work tool. The guide members may be separated by less than 60 mm or less, optionally, 40 mm or less. The separation of the guide members may correspond to the width of the tool pick-up point. The angle of the guide members may be less than 90 degrees, optionally less than 80 degrees, optionally 70 degrees.

The present disclosure may comprise: a material handling machine having a front and a rear defined by the principal direction of travel and a cab side and a lifting arm side on either side of a fore-aft centerline, the machine comprising: a body mounted on a ground engaging structure which includes a pair of front wheels and a pair of rear wheels, at least one of the pairs of wheels being movably orientated relative to the body to effect steering of the machine; a prime mover operable to drive the front and/or rear wheels to provide tractive effort for propelling the machine overground; a single telescopic lifting arm pivotally mounted towards an aft end of the body and located on the lifting arm side of the centerline, the lifting arm being located within a lifting arm housing comprising first and second sidewalls and a base wall; an operator cab mounted to the body on the cab side and adjacent to the lifting arm housing, wherein the operator cab comprises a seat and one or more control devices for controlling the ground engaging structure and/or an operation of the lifting arm, wherein the operator cab extends from the cab side of the machine across a width of the machine, wherein the operator cab further comprises a first cab sidewall and a second sidewall, the first and second sidewalls defining an internal width of the operator cab, wherein the internal width is at least 700 mm, and, wherein the weight of the machine is less than 2950 kg.

The present disclosure may comprise: a material handling machine having a front and a rear defined by the principal direction of travel, and a cab side and a lifting arm side on either side of a fore-aft centerline, the machine comprising: a body mounted on a ground engaging structure which includes a front pair of wheels and a rear pair of wheels, at least one of the pairs of wheels being movable relative to the body to effect steering of the machine; a single telescopic lifting arm pivotally mounted towards an aft end of the body and on the lifting arm side of the centerline, the lifting arm being located within a lifting arm housing comprising first and second sidewalls and a base wall; an operator cab mounted on the cab side of the body and adjacent to the lifting arm housing, the operator cab comprising a seat and one or more control devices for controlling the ground engaging structure and/or an operation of the lifting arm; and a prime mover located on the lifting arm side of the machine opposite the operator cab, wherein the prime mover extends through an aperture in the first wall of lifting arm housing and under the lifting arm.

The present disclosure may comprise: a material handling machine comprising: a body mounted on a ground engaging structure configured to propel the machine over ground and a single lifting arm having a distal end pivotally mounted towards an aft end of the body and a proximal end to which a tool carrier is mounted.

The tool carrier may comprise: a coupling portion connected to the lifting arm and an attachment portion for receiving a work tool, the coupling portion comprising: a pivot member pivotally attached to lifting arm and defining a pivot axis about which the tool carrier can pivot relative to the lifting arm, and a tilt mount attached to a tilt actuator of the lifting arm, wherein the tilt actuator is configured to rotate the tool carrier about the pivot axis; and, wherein the pivot member extends for less than 60% of the width of the tool carrier, optionally for less than 55%, or less than 50%.

The skilled person will appreciate that except where mutually exclusive, a feature described in relation to any one of the aspects, embodiments or examples described herein may be applied mutatis mutandis to any other aspect, embodiment or example. Furthermore, except where mutually exclusive, any feature described herein may be applied to any aspect and/or combined with any other feature described herein.

BRIEF DESCRIPTION OF DRAWINGS

Embodiments will now be described by way of example only with reference to the accompanying figures, in which.

DETAILED DESCRIPTION

Figure 1A:
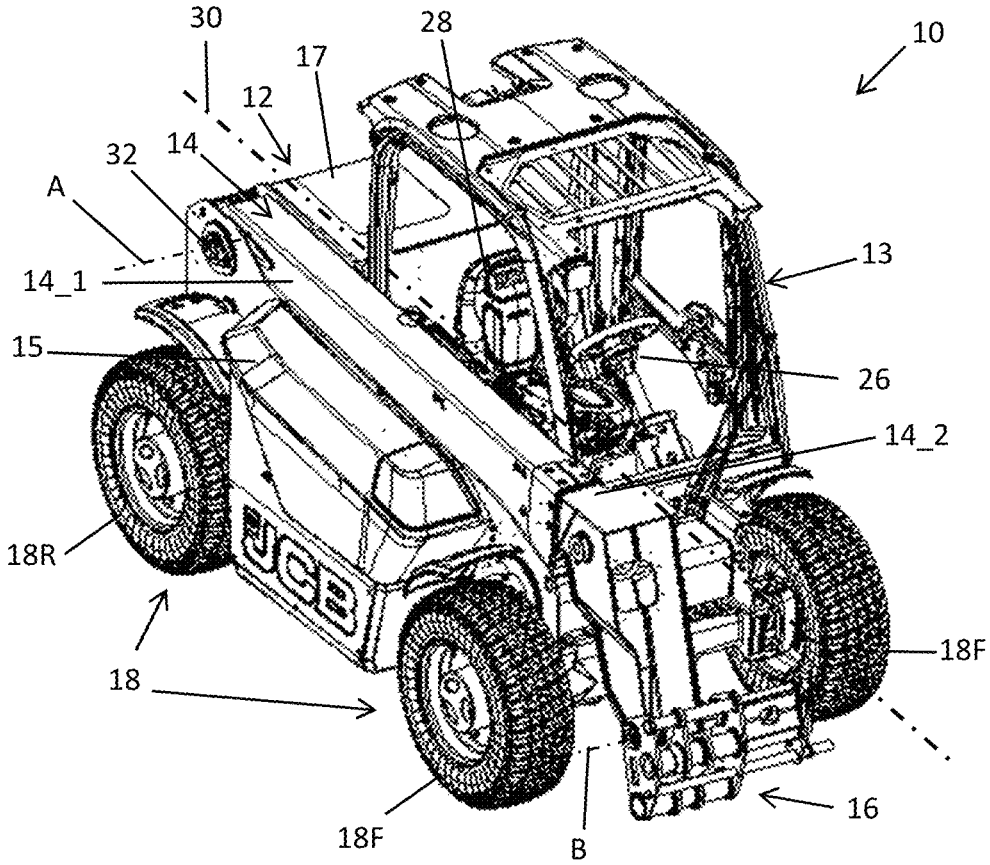
FIGS. 1*a* to 1*e* show various views of a material handling machine according to the present disclosure.
Figure 1B:
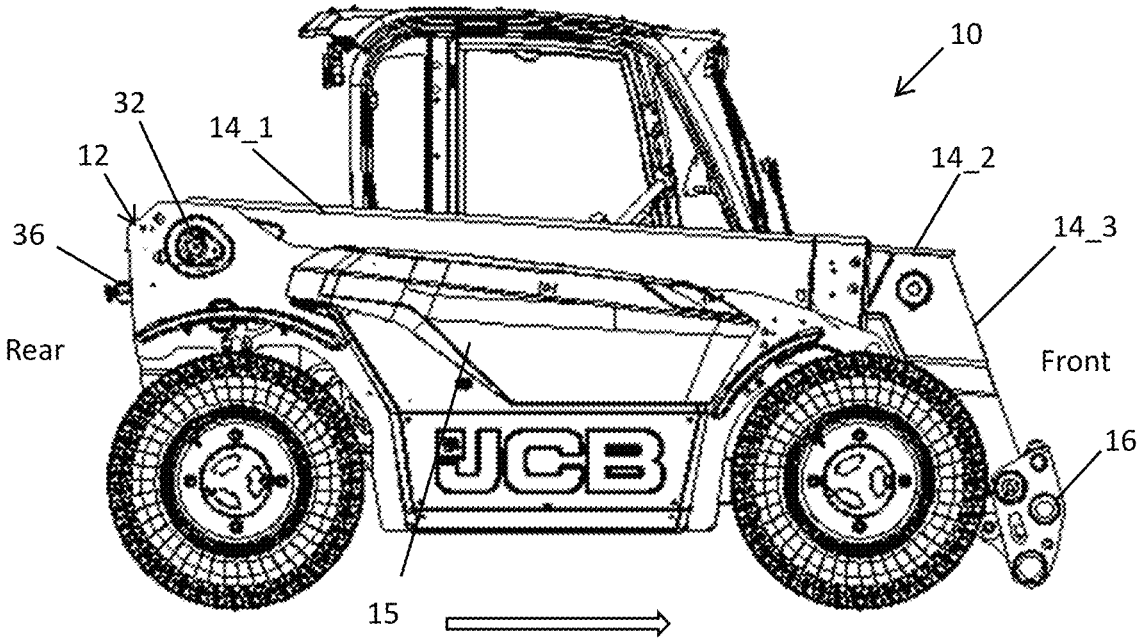
Figure 1C:
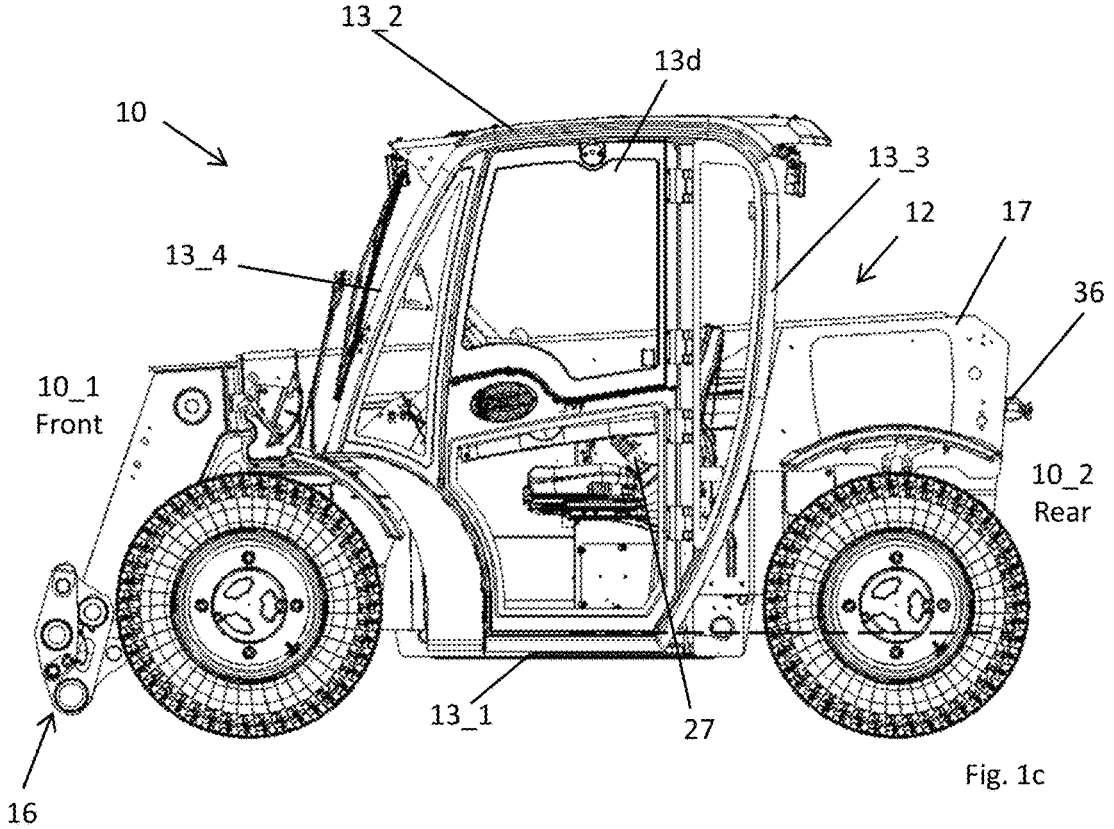

In the following detailed description, numerous specific details are set forth in order to provide a thorough understanding of various embodiments and the inventive concept. However, those skilled in the art will understand that: the present invention may be practiced without these specific details or with known equivalents of these specific details; that the present invention is not limited to the described embodiments; and, that the present invention may be practiced in a variety of alternative embodiments. It will also be appreciated that well known methods, procedures, components, and systems may not have been described in detail.

References to vertical and horizontal in the present disclosure should be understood to be in relation to the machine when stood on horizontal ground in a non-working condition. The term axial is generally used in relation to the longitudinal axis of the machine. The term width is generally used in relation to the longitudinal length, that is, transverse to the length.

With reference to FIGS. 1*a* to 16 there is shown a material handling machine 10 in the form of a telehandler according to a first embodiment. The telehandler is a compact machine which is trailer towable. As such, the machine 10 may comprise a weight which, when combined with a trailer, is below 3500 kg. Generally, this relates to a machine weight which is between 2500 kg and 2950 kg to allow for a trailer weight of between 550 kg and 1000 kg. Preferably, the machine will weigh between 2700 kg and 2900 kg.

The machine 10 comprises a front 10_1, a rear 10_2, a lifting arm side 10_3 and a cab side 10_4 with a width W and height H. The material handling machine 10 comprises a body 12, an operator cab 13, a lifting arm 14 pivotably mounted at a first end to the body 12 for pivoting movement about a first generally horizontal axis A (which may be referred to as the rear pivot axis A), and an engine housing 15, in which a prime mover 20 (FIG. 2) is located. The rear of the machine 10 may include a rear housing 17 for ancillary components or systems of the machine 10, to provide storage and/or a counterweight.

The lifting arm 14 is configured to carry a load via a handling implement (not shown) at a distal second end which opposite to the proximal first end. As such, the second end may comprise a tool carrier 16 (or a carriage) which is configured to attach to or comprises a working implement/work tool to the machine 10. The tool carrier 16 is configured to pivot relative to the lifting arm 14 about a second generally horizontal axis B (which may be referred to as a tilt axis B) so that a load may be kept in a constant horizontal or other chosen orientation as the lifting arm 14 pivots up and down, as well known in the art.

The body 12 is carried by a ground engaging structure 18 configured to provide a tractive effort to propel the machine over ground. The ground engaging structure 18 may form part of a powertrain comprising by a prime mover 20 and a drivetrain. In this example the prime mover 20 is an internal combustion engine (seen best in FIG. 2) and the drivetrain comprises a hydrostatic transmission 22 (best seen in FIG. 4), but other prime mover and drivetrain types in various combinations may be possible.

The body 12 and ground engaging structure 18 are provided in a fixed relation such that there is no relative movement between them in normal use. That is, the body 12 is not configured to rotate about a vertical axis, i.e. slew, in relation to the ground engaging structure 18 and the body 12 comprises a rigid or fixed frame which does not articulate as a wheeled loading shovel or other machines might.

The body 12 may comprise a chassis 24 (seen in plan in FIG. 6) which provides the main structural support for the material handling machine 10. The chassis 24 may provide structural support for the ground engaging structure 18, the prime mover 20, the drivetrain, the operator cab 13, the lifting arm 14 and associated actuators, and any ancillary equipment, components, systems or body work as may be required for the machine 10 to function. The chassis 24 may comprise a lifting arm housing having a first or outer sidewall 24_1, a second or inner sidewall 24_2, and a base wall 24_3.

The ground engaging structure 18 of the example shown in the figures comprises a front pair of wheels 18F and a rear pair of wheels 18R as well known in the art. The wheels 18F,18R may be configured to provide two wheel or four-wheel steering as also well known in the art. As such, either or both of the front and rear wheels may be configured to turn relative to the main body under the influence of a steering device provided within the operator cab 13 to effect steering. The steering device may comprise a steering wheel 26, lever or joystick 27, for example.

Either or both of the front 18F and rear 18R wheels may be driveably attached to corresponding axles 18_5 (shown in FIG. 12) which form part of the transmission/drivetrain of the material handling machine 10. There may be one or two drive shafts 18_6 attached to the axles/wheel assemblies to provide a two wheeled drive or four-wheel drive variants in various embodiments.

The operator cab 13 is mounted to the chassis 24 of the main body 12. The operator cab 13 is principally constructed from: a floorplate 13_1, which may define the underside of the machine 10; a roof 13_2, which may provide the uppermost surface of the machine 10 (when the arm is in a lowered, non-working position); an aft or rear wall 13_3; a front wall 13_4 comprising a windscreen, a first sidewall 13_5 (which may be referred to as an inboard cab sidewall or lifting side cab sidewall), and a second sidewall 13_6 (which may be referred to as an outboard cab sidewall or cab side sidewall).

Internally, there is provided an operator seat 28 and suitable controls for operating the machine 10. Thus, there may be one or more: steering device, such as a steering wheel 26, lever or joystick for example; input devices for operating the lifting arm 14, such as a lever or joystick 27; speed control devices for controlling the movement of the machine over ground, such as one or more foot controls (e.g. accelerator, brake), lever or joystick 27; a throttle control; one or more output devices for providing the operator with information pertaining to the operating state of the machine which may be visual (e.g. a display screen, warning lights) or audible (e.g. buzzer, speaker or other alarm); and, one or more input devices for configuring or operating various other aspects of the machine (e.g. switches, levers, touch screen display, joysticks, touch buttons).

The operator cab 13 may be conventional and be constructed from a glazed frame 13*a* including a number of structural members having panels or glass extending therebetween. The structural members may comprise corner pillars which extend between the floorplate 13_1 and roof 13_2, the floorplate 13_1, and roof 13_2. A door 13*d* is provided on the cab side for access.

The operator cab 13 may comprise an external width defined by the laterally outermost parts of the first and second sidewalls 13_5, 13_6. An internal width Wcab_int may be defined between the interior surface of the sidewalls 13_5, 13_6 windows or door 13*d*. The width Wcab_int will generally be measured transverse with respect to a longitudinal axis of the machine 10 and at a height which corresponds to the steering wheel 26, joystick 27 or seat 28, for example, where the space requirement for an operator is greatest. Although not shown, the cab 13 may taper towards the top so as to have a narrower upper width.

The operator cab 13 extends from the cab side 10_4, towards the lifting arm side 10_3 across the fore-aft centerline 30. The cab 13 is laterally offset so as to be positioned predominantly on one side of a longitudinal centerline 30 of the material handling machine 10. The opposing side of the cab 13 may be adjacent (and proximate) to the lifting arm 14 which, in turn, may be located next to or above the prime mover 22. Longitudinally, the cab 13 may be located between front and rear axles and/or the front 18F and rear 18R wheels of the drivetrain. That is, the cab 13 may not extend longitudinally beyond the front and rear axles or wheels 18F, 18R. In some embodiments, the cab may extend over the tires carried by the wheels 18F or 18R Relative to their larger counterparts, the size of an operator cab in state of the art compact material handling machines is typically reduced due to the limited width of the machine and the requirement to put the lifting arm towards and or over the center line to avoid unnecessary structural issues in the chassis. However, in the present disclosure, there is provided a compact material handling machine 10 comprising an operator cab 13 which is wider than the state of the art compact telehandler machines.

In order to provide the wider operator cab 13, the lifting arm 14 of the present disclosure is significantly laterally offset in relation to the centerline 30 of the machine 10 whilst maintaining the overall compact width W and weight of the machine 10. As such, there is provided a compact telehandler with a wider operator cab 13 for increased operator conditions and machine versatility which may be trailer towable.

It will be appreciated that providing a wider operator cab 13 on a compact machine 10 is generally advantageous as it provides an operator with more internal room. Operators may spend extended periods in the cab 13 and a wider cab provides a greater degree of space in which to move around and operate the machine 10. A larger cab 13 also provides space for additional features which can aid the comfort and operation of the machine 10. For example, the operator cab 13 of the present disclosure may comprise a fixed arm rest 13*b* adjacent to one or more input devices for controlling the machine, such as the steering wheel 26 or joystick 27. Hence, not only is an operator able to rest their arm in a naturally extended position (rather than being cramped up), but also move their arm to various positions throughout a work shift, as required. Further, a wider cab 13 allows a compact machine to be driven by operators having different sizes and shapes, thereby making the machine generally more versatile.

To describe the compact machine in an alternative way, the present disclosure provides a telehandler comprising a width in a range bounded by the values comprising 1650 mm, 1600 mm, 1550 mm, 1500 mm and 1450 mm. Hence, for example, the compact telehandler may comprise a width between 1450 mm and 1650 mm, or between 1550 mm and 1600 mm. The ratio of the operator cab width (internal or external) to the overall machine width may be greater than 0.45, 0.5, 0.55, 0.6 or 0.65. In the exemplary embodiment, the ratio of the internal width of the operator cab to width of the overall machine is approximately 0.56, with the ratio of the external width of the operator cab 13 to the overall machine being approximately 0.6.

The prime mover 20 may be an internal combustion engine which is side-mounted on the lifting arm side 10_3 of the machine 10. Side mounting of prime movers 20 is known and particularly advantageous for providing improved access for servicing and maintenance.

Further, providing a side mounted prime mover 20 (as opposed to rear mounted) allows for a convenient forward facing radiator 20_2 for improved cooling. Hence, in the material handling machine 10 of the present disclosure, the operator cab 13 may be positioned predominantly towards the cab side 10_4 of the material handling machine 10 with respect to centerline 30, and the prime mover 20 may be positioned towards an opposing second side of the material handling machine 10. The prime mover 20 may be positioned between the front and rear axles and/or wheels in that it does not extend beyond the front and/or rear axles and/or wheels in a direction parallel to centerline 30. Thus, the prime mover 20 may be longitudinally centrally mounted to one side of the material handling machine 10 and both the cab 13 and prime mover 20 may be arranged side-by-side at a mid-point of the machine 10.

The prime mover 20, may be provided in a fore-aft orientation meaning the rotational axis of the crank is generally parallel with the centerline 30. One or more radiators 20_2, 20_8 may be provided at the front of the prime mover 20 and face forwards to provide improved cooling, particularly when roading.

The prime mover 20 may be housed in an engine housing 15 which may include an access panel which is opened, e.g. via a hinged connection, or removed to provide access to the prime mover 20 for maintenance and servicing purposes, as well known in the art.

The lifting arm 14 (which may be referred to as a boom) may be provided by an elongate box section having a length which extends fore-aft on the machine 10, a transverse width 14*w*, and a vertical depth. The lifting arm 14 may comprise a telescopic boom having a plurality of nested sections which are configured to expand telescopically to adjust the length thereof upon demand. Thus, there is shown a first section 14_1 connected to a pivoting mount 32 and a second section 14_2 which is telescopically mounted within the first section 14_1. The second section 14_2 of the lifting arm 14 is longitudinally moveable with respect to the first section 14_1 such that the lifting arm 14 can be extended and retracted on demand from the operator cab 13 controls.

In order to accommodate the larger cab, the telescopic boom of the lifting arm 14 is positioned entirely on one side of the fore-aft centerline 30. In some embodiments, the center 14*c* of the lifting arm 14 may be between 0.65 W and 0.75 W from the cab side 10_4 where W is the width of the machine 10. In some embodiments, the lifting arm may have a width 14*w* between 175 mm and 225 mm.

The distal end of the lifting arm 14 extends from the pivot mount 32 which is located generally above the rear wheel 18R and aft of the cab 13 to the front of the machine 10. The tool carrier 16 is the foremost part of the machine, when no work implement is attached. The first section 14_1 comprises a straight section which is inclined slightly downwards from the pivot mount 32 for transportation and, when not in use, extends fore of the cab 13 to terminate above the front wheel 18F. The second section 14_2 extends colinearly from within the first section with a drop section 14_3 which is angled downwards with respect to the main boom so as to put the tool carrier 16 proximate the ground.

Telescopic movement of first and second section 14_1, 14_2 may be achieved by use of an extension actuator in the form of a hydraulic cylinder (not shown) housed within the lifting arm 14. The extension actuator may be any known in the art, such as a double acting hydraulic linear actuator. In some embodiments, extension may be achieved by use of an electric linear actuator, a telescopic extension ram, multiple extension rams, and/or a chain and pulley system which are also known in the art.

One end of the extension actuator may be coupled to the first section 14_1 with a second end coupled to the second section 14_2 such that extension and retraction of the extension actuator causes a corresponding movement in the lifting arm 14. As will be appreciated, the lifting arm 14 may include two, three, four or more sections.

The lifting arm 14 can be rotated about the lifting axis defined by the pivot mount 32 and axis A of the machine 10 to lift and lower loads. Rotational movement of the lifting arm 14 with respect to the machine body 12 may be achieved using a lift actuator 14_4 (shown in plan in FIG. 8) which is operable to manipulate the arm 14 in a vertical plane. The lift actuator 14_4 may be any suitable type but is typically a hydraulic cylinder, as shown, coupled at a first end 14_4*a* to the underside of the first section 14_1 and to the chassis at the second end 14_4*b*. The lift actuator 14_4 may be a double acting hydraulic linear actuator, but could be single acting cylinder. There may be multiple lift actuators 14_4.

As described further below, the lift actuator 14_4 is located within the lifting arm housing and extends in an aft-fore direction. The first end 14_4*a*, which is the cylinder end in the described embodiment, is attached to the chassis aft of the base wall 24_3 towards a rear of the machine 10, with the second end 14_4*b*, the rod end, is attached to the underside of the boom at a mid-portion between the proximal and distal ends. As will be described further below, when in a non-working position and lower extensions, the lift actuator 14_4 may extend through the base wall 14_3.

Figure 1D:
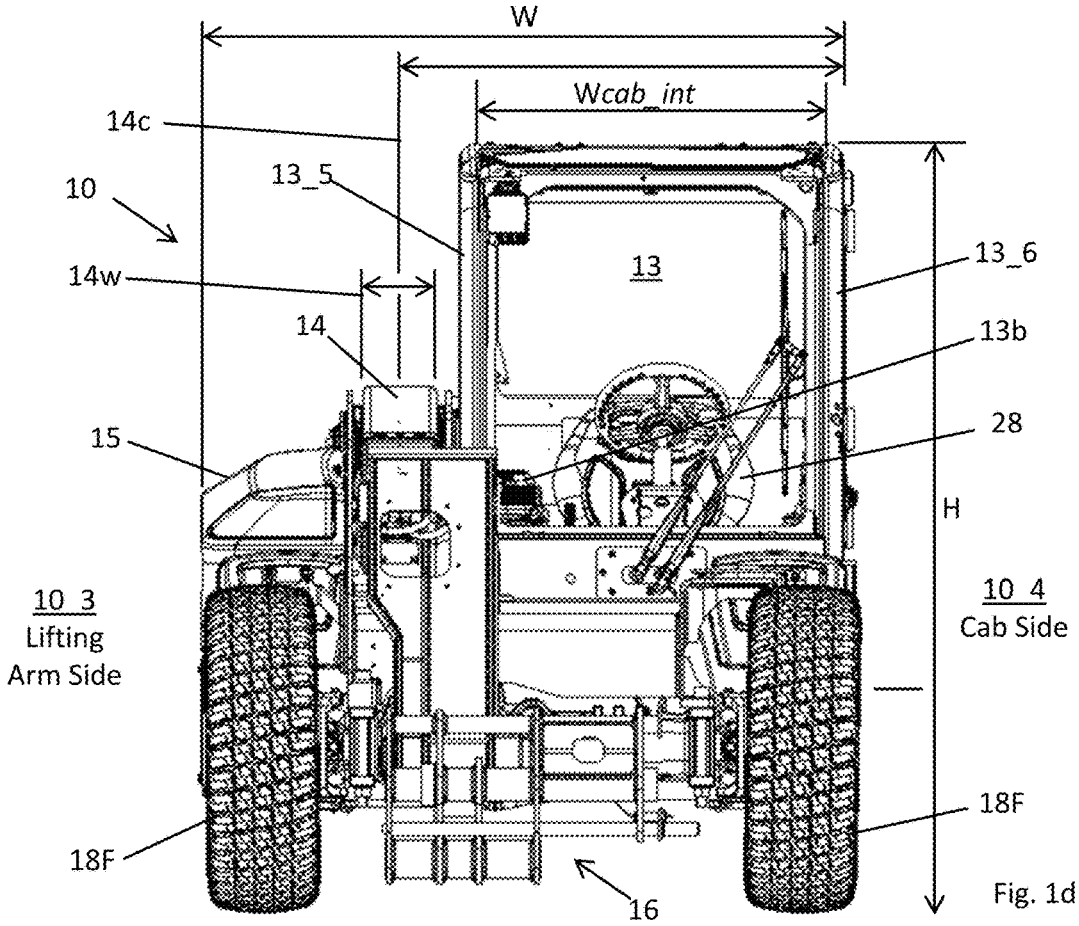

With reference to FIG. 1*d*, the compact material handling machine 10 of the present disclosure comprises width W. The width W may be defined by the lateral extremities or outermost edges of the machine body 12 and/or wheels and/or tires when viewed from the front or back of the machine 10. In some instances it may be more convenient to define the width of the machine as the sidewall of the cab 13 on one side and the engine housing 15 on the other. As such, the width W may be deemed to be defined by the maximum lateral separation between the engine housing 15 and the exterior cab side sidewall 13_6 of the operator cab 16, the wheel guards or wheels 18F, 18R. As can be seen, the location of the outer edges of the tires may correspond to the outer edges of the main body 12 such that the outer edges of the wheels and main body are substantially flush.

In some embodiments, the material handling machine 10 may comprise one or more steps to aid operator ingress and egress from the cab 13. These steps may project from the main body 12 but may not be incorporated into the overall width of the main body 12 per se. As such, the width W may be determined from the lateral extremities of the main body work, e.g. one or more external panels, or chassis as viewable from the exterior of the machine rather than one or more ancillary features which project from the main body 12. Other projecting features which do not define the width of the machine per se may comprise a wing mirror or a door hinge or the like.

The width W may be between 1450 mm and 1700 mm, optionally between 1500 mm and 1600 mm, 1530 mm and 1570 mm or 1545 mm and 1560 mm.

As noted, the material handling machine of the present disclosure may be towable on a trailer on highway. Legislation in the UK, Europe and elsewhere sets a combined towing weight limit of 3500 kg. In the case of a compact material handling machine, this effectively sets a practical weight limit to around 2900 kg, which allows a weight of 600 kg for the trailer, although some trailers are lighter. The trailer may be defined by the inclusion of suitable conventional inertial or overrun brakes which are independently operable in response to the braking of the towing vehicle and may also be defined by the inclusion of a breakaway cable configured to apply the brakes in the event of a detachment from the towing vehicle. The trailer may comprise a conventional ball hitch for use by a domestic or light commercial vehicle and would typically be twin axle.

The material handling machine 10 of the present disclosure may comprise a weight of between 2500 kg and 2950 kg. In preferred embodiments, the weight may be between 2600 kg and 2800 kg or between 2650 kg and 2750 kg, or approximately 2700 kg. The weight of the material handling machine may exclude a lifting implement attached to the lifting arm. Where the lifting implement is attached, the preferred weight may be between 2700 kg and 2900 kg. The weight may be taken to have an ordinary meaning and represent the unladen weight of the machine and without the operator. The weight may be referred to as a "wet weight" or "kerbside weight".

Figure 1E:
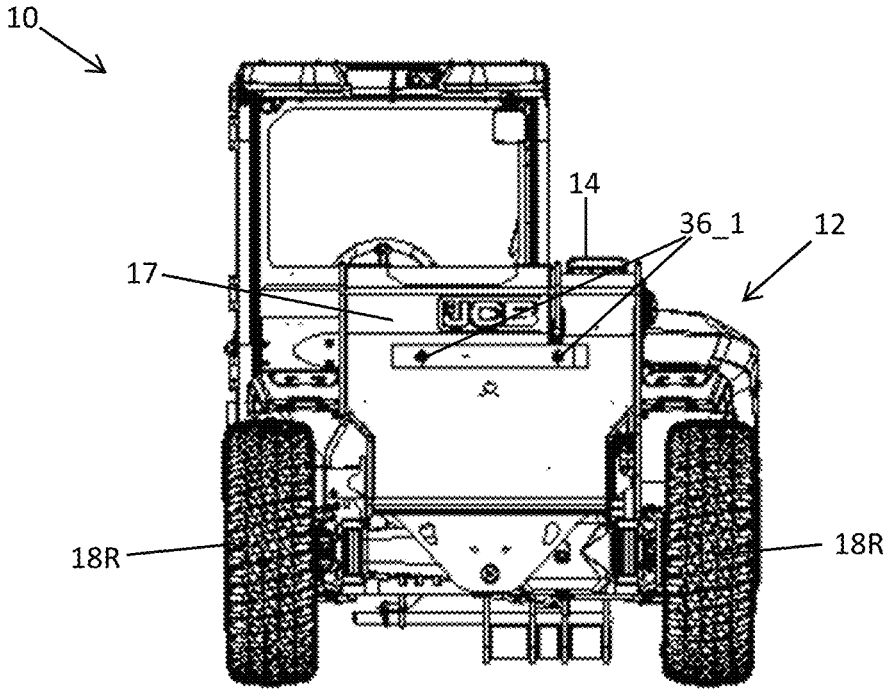
Figure 2:
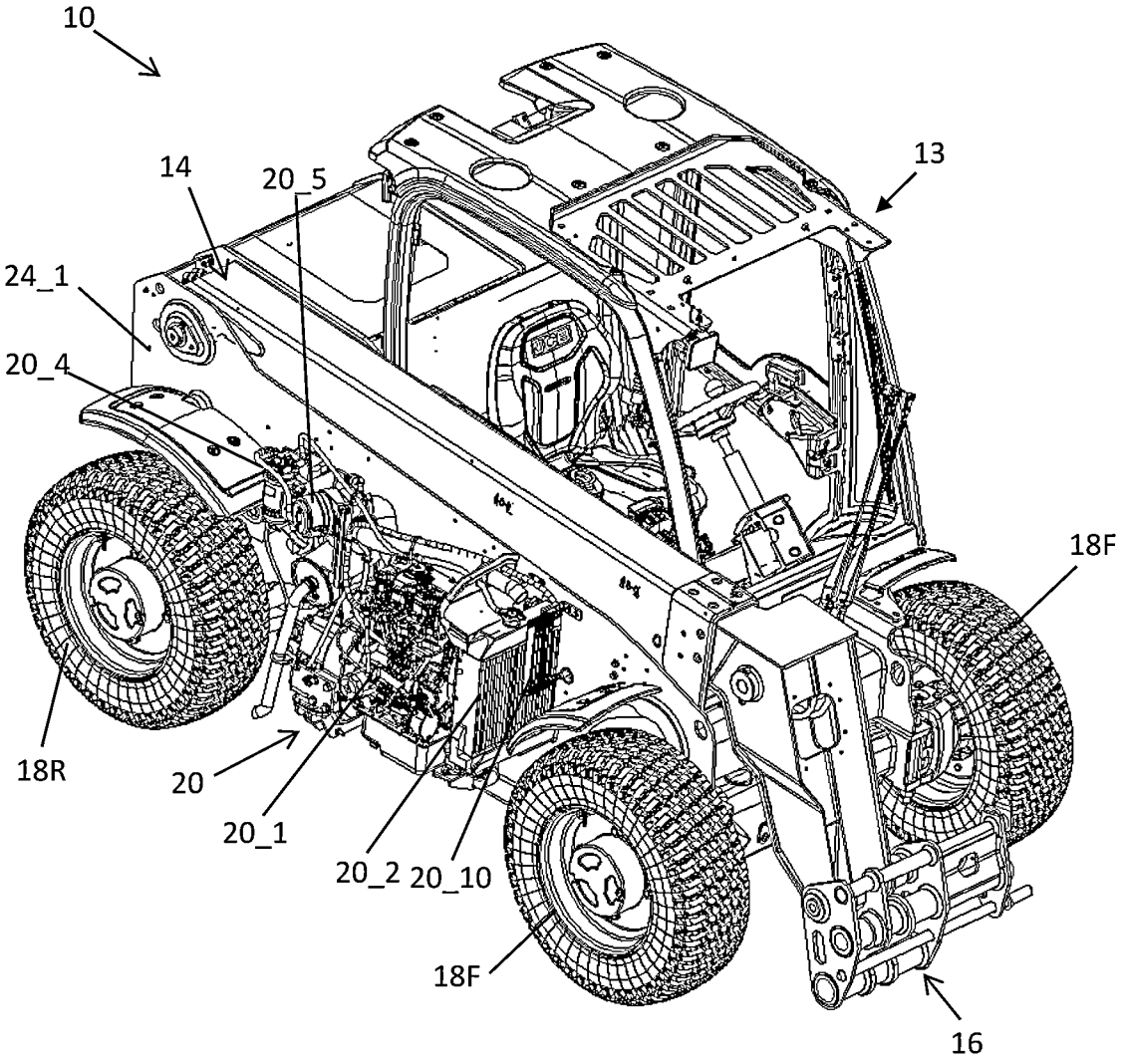
FIG. 2 shows the material handling machine of FIGS. 1*a* to 1*e* with an engine housing removed.
Figure 3:
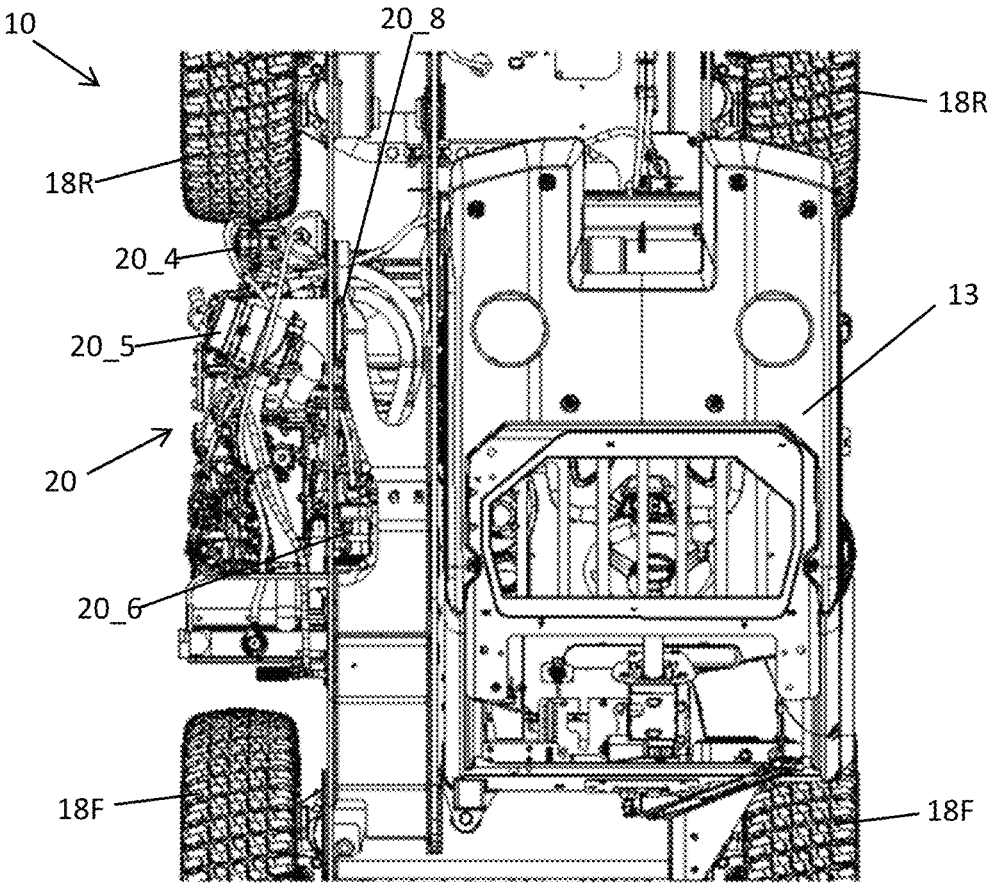
FIG. 3 shows a partial plan view of the material handling machine with the engine housing and lifting arm removed.
Figure 4:
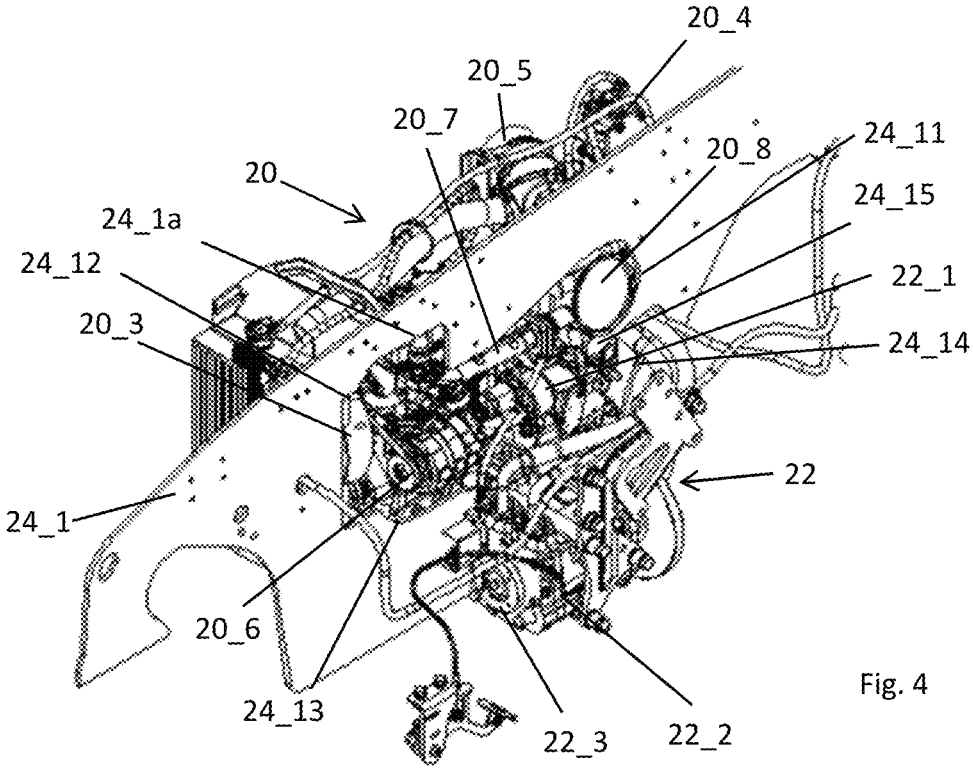
FIG. 4 shows a perspective inboard view of a first sidewall of a lifting arm housing with portions of a prime mover extending therethrough.
Figure 5:
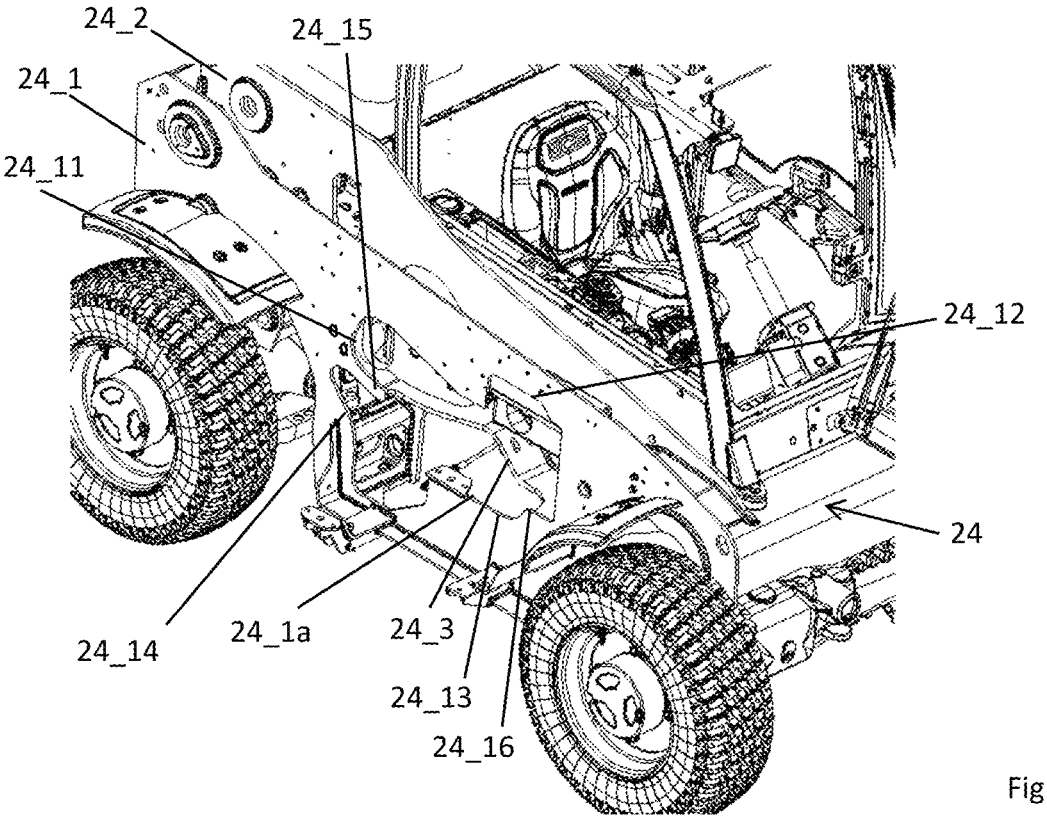
FIG. 5 shows an external perspective view of the first sidewall of FIG. 4 with the prime mover removed to reveal a lobed aperture through which the engine extends.
Figure 6:
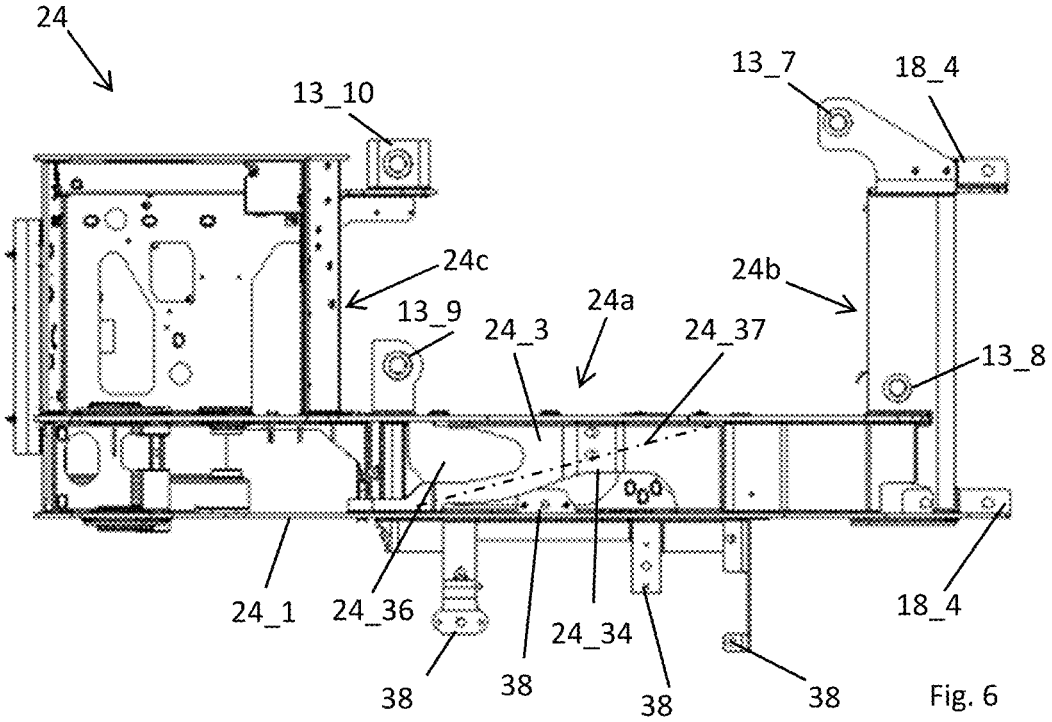
FIG. 6 shows a plan view of a chassis of the machine according to the present disclosure.

Turning to FIG. 2, there is shown the material handling machine 10 of FIGS. 1*a*-1*e* with the engine housing 15 removed. Hence, there can be seen the operator cab 13, lifting arm 14, chassis 24 and prime mover 20 located between the front 18F and rear 18R wheels. FIG. 3 shows a partial plan view of the material handling machine 10 in which the lifting arm 14 and engine housing have been omitted to reveal the underlying structure of the chassis 24. The prime mover 20 and operator cab 14 can be clearly seen with the prime mover 20 extending partially through an outer wall 24_1 of the chassis 24. FIG. 4 shows a view of the prime mover 20 and hydrostatic drive 22 from the interior of the machine to highlight the extension of the prime mover 20 under the lifting arm 14 as it extends through the outer chassis wall/lifting arm housing first sidewall 24_1 with other components omitted. FIG. 5 shows the outer chassis wall 24_1 with the prime mover 20 and lifting arm 14 removed to highlight the aperture 24_1*a*. FIG. 6 shows the chassis 24 in isolation in plan-view.

The chassis 24 comprises a main body portion 24*a* which extends longitudinally aft-fore, a front transverse section 24*b* and a rear transverse section 24*c*. The main body portion 24*a* provides the main structural support for the machine 10 and a lifting arm housing in which the lifting arm 14 is partially stowed when in a retracted lowermost position. The main body part 24*a* also houses part of the lift actuator 14_4.

The main body portion 24*a* comprises an outer wall 24_1, an inner wall 24_2 and a base wall 24_3 (or deck plate as it may be referred to), which extends therebetween.

The inner 24_2 and outer 24_1 sidewalls are provided by plates which extend parallel to one another and the longitudinal axis and lie in vertical planes. The sidewalls 24_1, 24_2 provide a partial housing for the first section of the lifting arm 14 when in a lowermost non-working position and support for the pivot mount 32. The inner 24_1 and outer 24_2 sidewalls are separated by a dimension which is comparable to the width 14*w* of the lifting arm such that the lifting arm 14 may be received with a suitable clearance. The inner 24_2 and outer 24_1 walls connect to the rear transverse section 24*c* at the rear and to the front transverse section 24*b* at the front of the machine 10.

The base wall 24_3 extends laterally between the outer wall 24_1 and the inner wall 24_2 and longitudinally along the length of the chassis 24 to provide structural support and torsional stiffness between the sidewalls 24_1, 24_2 and to the chassis more generally and aids the offset of the lifting arm required to accommodate the wider cab 13. The base wall 24_3 is described in more detail below.

In addition to the base wall 24_*c*, the first 24_1 and second 24_2 sidewalls may be connected by a plurality of connecting portions provided by the front 24*a* and rear 24*c* transverse sections and separate struts and box sections.

The front transverse section 24_*b* extends laterally from the main body portion 24*a* and provides support for the front axle 18_5, front wheel assemblies 18_1, 18_10 and front portions of the operator cab 13. As such, there can be seen two fore cab mounts 13_7, 13_8 for the operator cab 13 and mounting points 18_4 for the wheel assembly.

The rear transverse section 24*c* extends laterally from the main body portion 24*a* and provides the rear housing 17 for ancillary services and associated equipment at a convenient location for an operator or maintenance person to access. The rear housing 17 may comprise a fuel tank and/or fuel filling point and/or fuel pump, a brake fluid reservoir, screen wash reservoir, battery, hydraulic oil filling point and electrical fuses, for example. The exterior or the rear transverse section may provide the external surface of the material handling machine or may comprise one or more external panels or cladding to provide the exterior surface. The rear housing may comprise one or more doors, e.g. a hood or boot lid, which to enclose the interior of the rear housing whilst providing convenient access.

The rear transverse section 24*c* may also provide a suitable location for the machine counterweight (not shown), which is provided to counterbalance load carried by the lifting arm as well known in the art. In the described example, the counterweight is provided by the weight of the rear compartment but may include the safety strut as described below.

In order to provide sufficient space for a wider operator cab 13 with a side mounted prime mover 20, it is necessary for parts of the prime mover 20 to extend into the chassis 24 and under the lifting arm 14. Hence, as can be seen best in FIGS. 4 and 5, the outer wall 24_1 of the chassis main body portion 24*a* comprises a large aperture 24_1*a* through which portions of the prime mover 20 extend. As such, the prime mover 20 may be moved towards the centerline of the machine 10.

The prime mover 20 may comprise: an engine block 20_1 which comprises the crankcase and cylinders, a cylinder head which comprises a valvetrain arrangement and cylinder head cover; a radiator 20_2, radiator fan and radiator fan housing 20_3, a fuel filter 20_4, an air filter 20_5, an electrical generator 20_6, exhaust manifold 20_7, an exhaust diesel particulate filter and exhaust muffler 20_8 and a fuel cooling radiator 20_9, with one or more of these components being wholly or partially housed on the interior of the chassis and underneath the lifting arm 14.

In the embodiment shown in FIGS. 2 to 4, the radiator fan housing 20_3, electrical generator 20_6, exhaust manifold 20_7, and exhaust muffler 20_8 all extend partially through the chassis outer wall 24_1 so as to be located within the chassis under the lifting arm 14.

Also shown in FIG. 4 is a hydraulic pump 22_1 and hydraulic motor 22_2 which form a hydrostatic drive 22 as part of the drivetrain. The hydraulic pump 22_1 is operably attached to the prime mover 20 so as to be driven thereby in a conventional manner. It will be appreciated that the hydraulic pump 22_1 may be utilized for purposes other than the hydrostatic transmission 22, such as providing hydraulic power for the lift actuator or other hydraulic services. In some embodiments there may be a separate hydraulics pump for the non-transmission related hydraulic services.

As shown in FIG. 4, the hydraulic pump 22_1 may be located inboard of the prime mover 20 and extend through the outer wall of the chassis to be at least partially located beneath the lifting arm 14. The hydraulic motor 22_2 and hydraulic pump 22_1 may be located fully beneath the lifting arm 14.

The pump 22_1 and motor 22_2 may be connected by a plurality of hydraulic fluid conduits which provide flow communication for hydraulic fluid between the two components, as well known in the art. As can be seen, the hydraulic motor 22_2 comprises a drive shaft connector 22_3 on the front thereof which is coupled to a drive shaft in use, as described further below. As with the prime mover 20, the hydrostatic pump 22_1 and motor 22_2 may be located longitudinally at a mid-portion of the machine and between the front and rear wheels 18F, 18R.

It will be appreciated that the chassis 24 and outer chassis sidewall 24_1 which provides the lifting arm housing provide structural support for the material handling machine 10 and, as such, must have a suitable level of strength and rigidity. However, the encroachment of the prime mover 20 and elements of the transmission system 22 through the chassis wall 24_1 via an aperture 24_1*a* inherently weakens the strength and rigidity of chassis 22. This is particularly so where the lifting arm is laterally mounted.

In order to help overcome this, the present disclosure provides an aperture 24_1*a* which is shaped to allow specific parts of the engine 24 to extend through the chassis outer wall 24_1 whilst retaining as much of the structure as possible. As such, the chassis aperture 24_1*a* may comprise an irregular shape in which a plurality of sections or lobes are provided to correspond to a shape of the components which extend through them. In other words, the peripheral edge of the aperture 24_1*a* comprises a lobed profile having a plurality of distinct sections in which different components of the prime mover 20 and/or transmission system are located.

Hence, as can be seen in the embodiment of FIG. 5, there may be a first lobe 24_11 for receiving a part of the exhaust system, a second lobe 24_12 for receiving fluid carrying conduits and/or parts of the water cooling system, a third lobe 24_13 for receiving the electrical generator, and a fourth lobe 24_14 for receiving parts of the hydrostatic drive 22. The number and position of the lobes may vary in different embodiments as may the components which are received by the different lobes. As such, some embodiments may have more or fewer lobes and the component received within the lobes may differ according to the construction of the prime mover 20.

In the embodiment shown in FIG. 4, the exhaust muffler 20_8 is provided within a lobe 24_11 in which an edge of the aperture 24_1*a* corresponds to the external profile of the engine muffler 20_8. Thus, there can be seen a generally arcuate section of the aperture 24_1*a* towards an upper aft portion thereof and surrounds the exhaust muffler 20_8. The first lobe 24_11 may extend around the muffler 20_8 by more than 180 degrees.

An upper end of the first lobe 24_11 extends linearly forwards and above the exhaust manifold 20_7 which is connected into the muffler 20_8. The exhaust manifold 20_7 may be lower than the muffler 20_8 allowing the edge of the aperture 24_1*a* to descend from the muffler lobe as it extends forwards. Towards the fore portion of the prime mover 20, the aperture 24_1*a* extends vertically to provide the second lobe 24_12 for receiving the coolant radiator and, optionally, a portion of the oil cooler and, optionally, the fan housing 20_3. The third lobe 24_13 may receive conduits which extend to and from the radiator, oil cooler and fan housing. The alternator 20_6 is located aft of the fan housing 20_3 within a fourth lobe 24_14. Thus, as the edge of the aperture 24_1*a* extends rearwards from the third lobe 22_13, the height drops to provide space for the armature 20_6 and any associated drive belts.

The lowermost aft portion of the aperture 24_1*a* comprises a fourth lobe 24_14 which is shaped to receive the bulk of the hydraulic pump 22_1 and hydraulic hoses which extend between the hydraulic pump 22_1 and hydraulic motor 22_2. The fourth lobe 24_14 is located below the exhaust muffler lobe and exhaust manifold.

An advantage of using a lobed aperture and selecting the positions and relative spacings of the various components of the prime mover 20 is that portions of the sidewall 24_1 can project radially inwards towards a central region of the aperture and between the various components to provide an anchor point for one or more structural reinforcing members. Using said projections, the span of the aperture 24_1*a*, either vertically or horizontally, might be minimized for the size of prime mover 20.

An example of a projection is shown in FIGS. 4 and 5 where there is provided a projection 24_15 which extends between the first and fourth lobes 24_11, 24_14. The projection 24_15 extends forwards from an aft portion of the aperture 24_1*a* radially inwards such that the minimum longitudinal extent of the aperture is reduced. The projection 24_15 provides a suitable attachment point for a structural member such as the base wall 24_3 or a suitable strut and allows the reduction in strength resulting from the introduction of the aperture 24_1*a* to be at least partially mitigated. A similar projection 24_16 is provided towards the lower front corner of the aperture 24_1*a* for connecting with the base wall 24_3 below the radiator fan housing 20_3.

With reference to FIGS. 3 and 5 to 8, the embodiment of the present disclosure comprises a base wall 24_3 which extends between the lifting arm housing outer wall 24_1 and lifting arm housing inner wall 24_2. The base wall 24_3 may comprise a plate-like member which spans laterally between the outer and inner walls 24_1, 24_2, and longitudinally across the aperture 24_1*a* so as to connect the opposing ends thereof.

The base wall 24_3 may extend across the aperture 24_1*a* mid-height of the chassis outer wall 24_1 and aperture 24_1*a* and comprise one or more cut-outs to receive the parts of the prime mover 20 which extend through the aperture 24_1*a* into the lifting arm housing. As with the aperture 24_1*a*, the cut-outs may be located to allow specific components to be received within the lifting arm housing between the outer and inner walls 24_1, 24_2.

Figure 7:
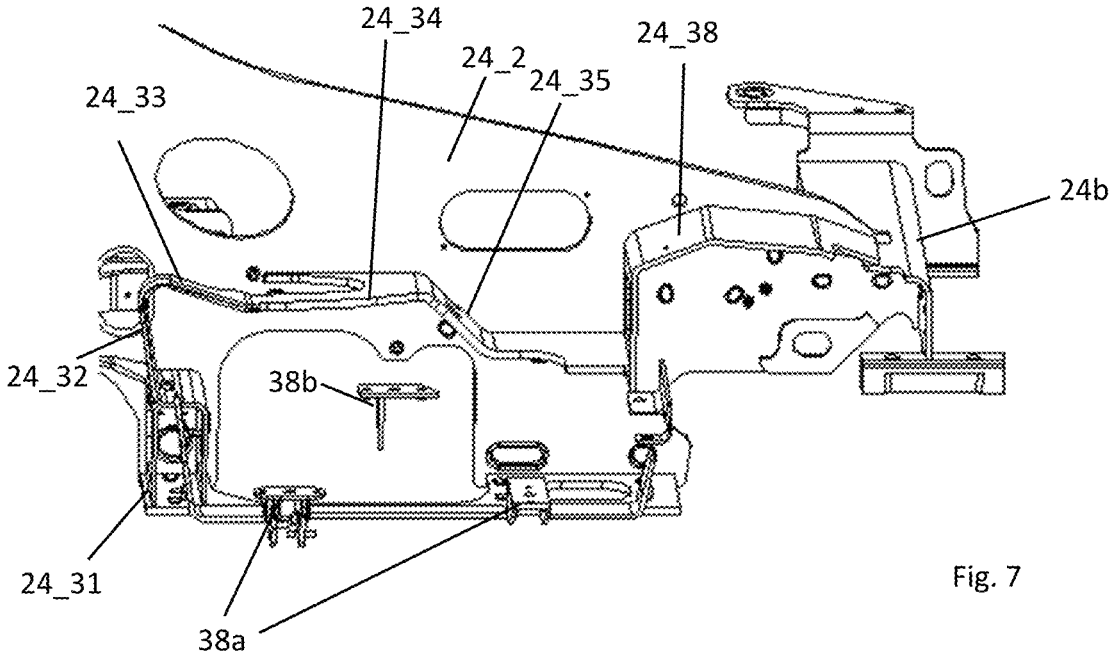
FIG. 7 shows an inclined side view of a base wall of the lifting arm housing with the outer, first wall of the lifting arm housing removed.

With specific reference to FIG. 7 (which shows a slightly inclined side view of the base wall 24_3 with the outer wall 24_1 removed), the base wall 24_3 extends longitudinally from aft of the aperture 24_1*a* to the front of the chassis 24 where it joins with the front transverse section 24*b*. The base wall 24_3 comprises a plurality elevations with differing heights to aid structural rigidity.

The aftmost terminal end of the base wall 24_3 attaches to strut 24_31 in the form of a box section which extends laterally between the outer and inner walls 24_1, 24_2, aft of prime mover 20 and towards the lowermost edge of the chassis 24. The base wall 24_3 comprises a first riser 24_32 which extends upwards from strut 24_31 and is inclined rearwards slightly to meet the aftmost edge of the aperture 24_1*a* provided by the lowermost lobe 24_14 where the hydraulic transmission hoses extend through the outer wall 24_1. The base wall 24_3 then extends in a continuous sweep around the hydraulic hoses with a bend radius which matches the edge of the aperture 24_1*a* before descending along a connection 24_33 with the elongate wall projection 24_15 towards its terminal end between two of the lobes and associated prime mover 20 and/or hydrostatic drive 22 components.

As best seen in the plan view of FIGS. 3 and 6, the outer edge of the base wall 24_3 which is proximate the prime mover 20 tapers inwards from the terminal end of the projection 24_15 towards the inner wall 24_2 and away from the prime mover 20 so as to provide a space for the exhaust manifold 20_7, alternator 20_6 and cabling and/or conduits associated with the alternator or prime mover 20 more generally. Upstream of the alternator 20_6, the base wall 24_3 returns to the outer wall 24_1. Hence, the base wall 24_3 comprises a recess 24_34 in which portions of the prime mover 20 and/or hydrostatic drive 22 may be located.

As best seen in FIG. 7, a mid-portion of the base wall 24_3 adjacent the prime mover 20 comprises a downward slope 24_35 such that vertical height is lower towards the front of the prime mover 20 when compared with the rear. More specifically, the portion of the base wall 24_3 which extends across the aperture 24_1*a* comprises a first horizontal landing at a first height which is proximate the rear of the prime mover 20, and a second horizontal landing which is proximate the front of the prime mover 20. The portion between the two landings is provided by the downward slope 24_35 which is inclined at approximately 45 degrees to the horizontal.

The different heights of the base wall 24_3 may be used to accommodate various components either above or below the base wall 24_3. For example, the hydrostatic drive 22 may be fully or partially located under the first elevated section which is at a higher height. The lower landing is provided to pass underneath the alternator. It will be appreciated that other configurations and locations of components above and below the base wall 24_3 may be possible.

Figure 8:
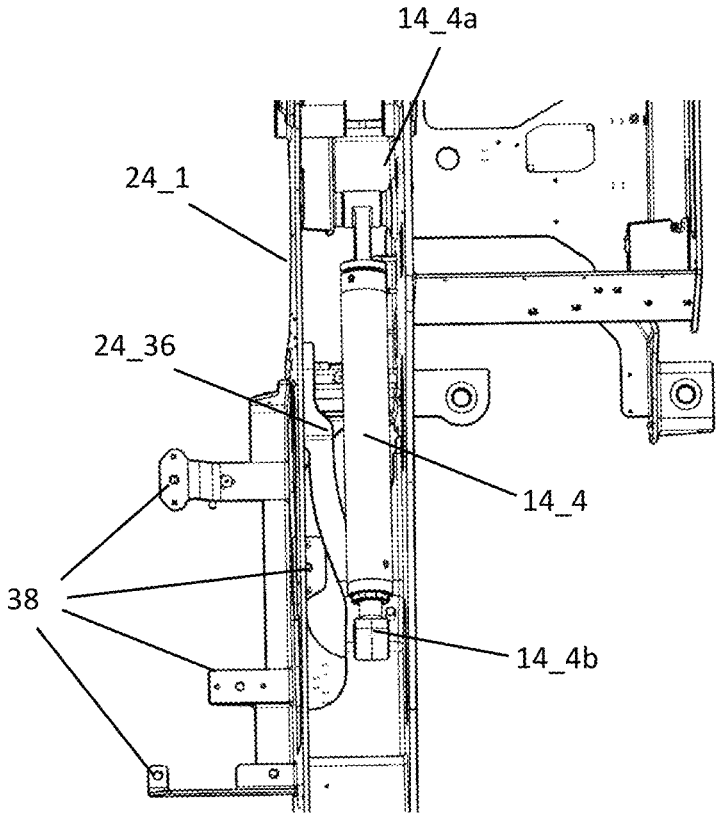
FIG. 8 shows a partial plan view of the lifting arm housing and a lift actuator located therein.

Returning to FIG. 6, it can be seen that the aft portion of the base wall 24_3 comprises an elongate lift actuator cut out 24-36 (which may be referred to as a recess) which extends forwards from the aft edge and is positioned to receive the cylinder of the lift actuator 14_4, as shown in FIG. 8. The extent of the lift actuator recess 24-36 can be varied according to the requirements lift actuator. In the embodiment shown in FIG. 8, the lift actuator recess 24_36 extends forwards of the projection 24_15 and terminates within the first landing and aft of the slope 24_35. The shape of the recess 24-36 is sufficient to provide the necessary clearance for the cylinder 14_4 and may be described as being generally parabolic but this is not a limitation. As can be seen in FIG. 6, the shape of the base wall 24_3 with the cylinder 24_36 and prime mover recess 24_34 can be described as being generally y shaped with the lift actuator 14_4 being received within the bowl of the y-shape, with the descender wrapping around the prime mover 20.

The shape of the base wall 24_3 when viewed from above provides a straight-line connection 24_37 which extends diagonally from the outer wall 24_1 aft of the prime mover 20 to the inner wall 24_2 towards the front of the prime mover 20. In doing so, there is provided structural support which increases the torsional rigidity of the chassis 24 whilst accommodating the prime mover 20 and the lift cylinder 14_4 in a reduced width machine with a large cab 13.

Upstream of the prime mover 20, the base wall 24_3 terminates with a box section 24_38 which extends between the outer 24_1 and inner 24_2 walls. The forward box section 24_38 extends upwards and forwards from the base wall 24_3 to meet the first transverse section 24*b* and provide structural rigidity. The shape of the fore box section 24_38 might be described as a lower case r in shape with the vertical arm being connected to the base wall 24_3 at a mid-height portion thereof, and the terminal end of the opposing curved section dipping to meet and attach to the front transverse section 24*b*. An upper surface of the box section may be angled to correspond to the boom angle when in a non-working position.

The base wall 24_3 may be attached to the outer and inner walls 24_1, 24_2 by any suitable mechanical method, preferably welding. The base wall 24_3 may be attached along all of the contacting edges.

Referring to FIGS. 5, 6 and 7, the prime mover 20 is mounted on a plurality of engine mounts 38 which are distributed fore and aft and on either side of the prime mover 20. The engine mounts 38 are provided by suitable pads which are either mounted directly to the edge of the aperture 24_1*a* or are located on cantilevers which extend perpendicularly from the outer wall 24_1. In the embodiment shown there are four engine mounts, three on the outside of the outer wall 24_1 on cantilevers, and one provided on a lower edge of the engine aperture 24_1*a* and extending inwards of the outer wall 24_1.

Figure 9:
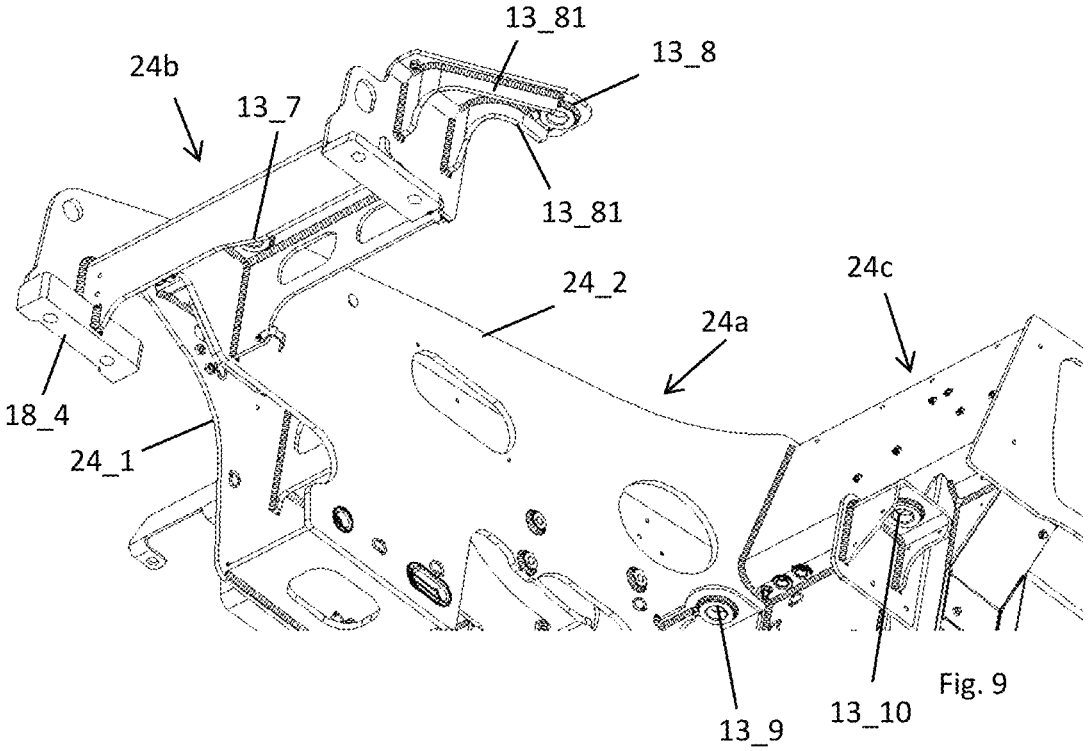
FIG. 9 shows an underside of a front transverse section and front wheel assembly mounts.
Figure 10:
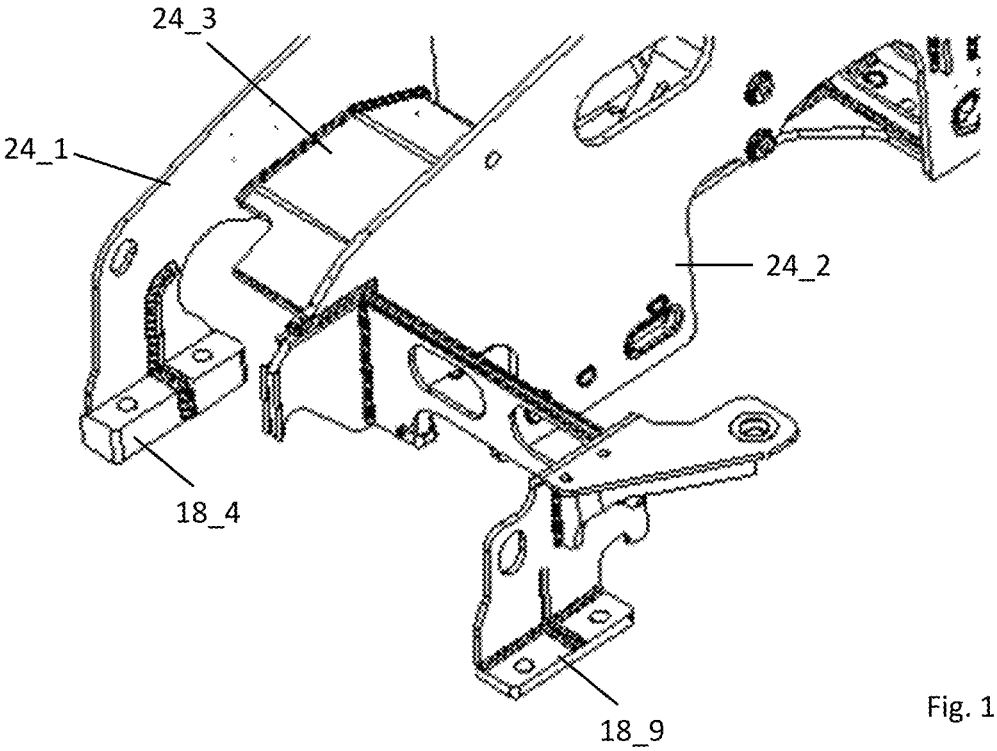
FIG. 10 shows a top-down perspective view of the front transverse section and front wheel mounts.
Figure 11:
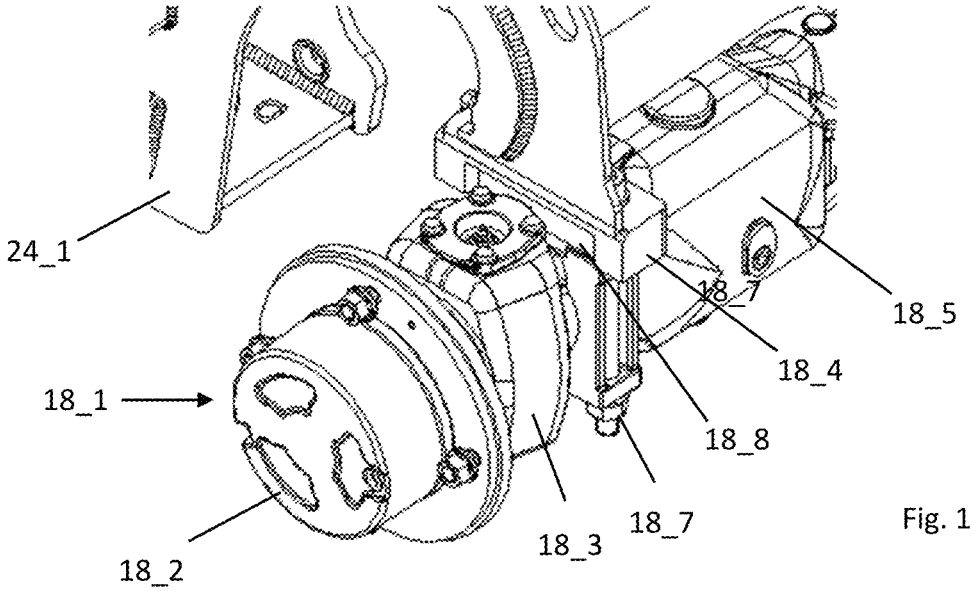
FIG. 11 shows the lifting arm side wheel assembly.

Referring to FIGS. 6, 9 and 10, the chassis 24 may include a plurality of cab mounts 13_7, 13_8, 13_9, 13_10, on to which the cab 13 may be mounted. The cab mounts 13_7 . . . 13_10, may be placed in any suitable location but will typically be located towards the corner regions of the cab 13. Thus, there is provided a chassis 24 comprising a plurality of cab mounts 13_7 . . . 13_10 which are either provided directly on the chassis 24 or on cantilevers. In FIG. 6, there is provided a first fore cab mount 13_8 on the front transverse section 24*b* adjacent the connection point to the main body portion 24*a*. A second fore cab mount 13_7 is provided on a cantilever which extends outwards from the terminal end of the front transverse section 24*a*. The cantilevered fore cab mount 13_7 may extend from an end member of the front transverse section 24*b* which provides mounting structure for the near side wheel mount, described below.

A first aft cab mount 13_9 is provided on a cantilever member which extends perpendicularly from the inside of the inner wall 24_2. A second aft cab mount 13_10 is provided by a further cantilever which extends forwards from the rear transverse section 24*c*.

In order to accommodate the larger cab 13 and offset boom of the lifting arm 14, in particular with a side mounted prime mover 20, it may be advantageous to allow the cab 13 to become a load bearing structure. In prior art machines, the cab 13 is typically not considered to be a load bearing structure but is provided as a modular independent structure on a rigid chassis 24 which is designed not to flex under normal use conditions. The present disclosure teaches the use of an operator cab 13 which is provides structural rigidity and prevents movement of the chassis 24 such that the offset lifting arm 14 and wider cab 13 can be accommodated.

In order to allow the cab 13 to be used as a structural element of the machine 10, the cab mounts 13_7 . . . 13_10, are provided with local reinforcement members which can form part of a load path through the chassis 24 and cab 13. As such, the cab mounts 13_7 . . . 13_10, may be configured to carry 7200N. However, it will be appreciated that in other embodiments, one or more of the cab mounts 13_7 . . . 13_10, the fore cab side mount 13_8 in particular, may be configured to carry a load of greater than 6000N, greater than 6500N, greater than 7000N or greater than 7200N.

As can be seen in FIG. 5, the operator cab cab mount 13_7' which attaches to the chassis cab mount 13_7 is provided with strengthening members in the form of one or more webs which extend between the front wall of the cab and a cab mount bracket which sits on mount 13_7. The wall of the cab 13 may be a vertical wall with the cab mount bracket extending horizontally therefrom. The strengthening members may comprise one or more webs or flanges, either singly or as part of a box section or the like as shown. In the embodiment, the strengthening member comprises a u-shaped channel but other forms are possible. Similar strengthening members may be provided on the other operator cab cab mounts and so will not be described further.

Where a chassis cab mount 13_8 is provided by a cantilever, it may be preferable to provide strengthening members to an underside thereof. Thus, as can be seen in FIG. 9, there is provided a cab mount 13_8 as a cantilever member extending rearwards and outwards from the front transverse section 24*b* having a pair of gusset plates 13_81 extending along the underside of the cantilever and to either side of the cab mount 13_8.

With these reinforcements it is possible to further distribute the working load of the lifting arm through the cab 13 and provide a machine 10 having a wide operator cab.

The compact telehandler 10 of the present disclosure provides a laterally offset lifting arm 14 which is located in a lifting arm housing comprising opposing parallel walls 24_1, 24_2 of the chassis 24. In order to accommodate the larger than conventional cab 13, it is desirable to position the outer wall 24_1 laterally as far towards the lifting arm side wheels as possible. In order to maximize this, the outer wall 24_1 may longitudinally overlap with wheel assembly either at the front or the rear of the machine. Thus, the line of the outer wall may dissect the wheel assembly.

Figure 12:
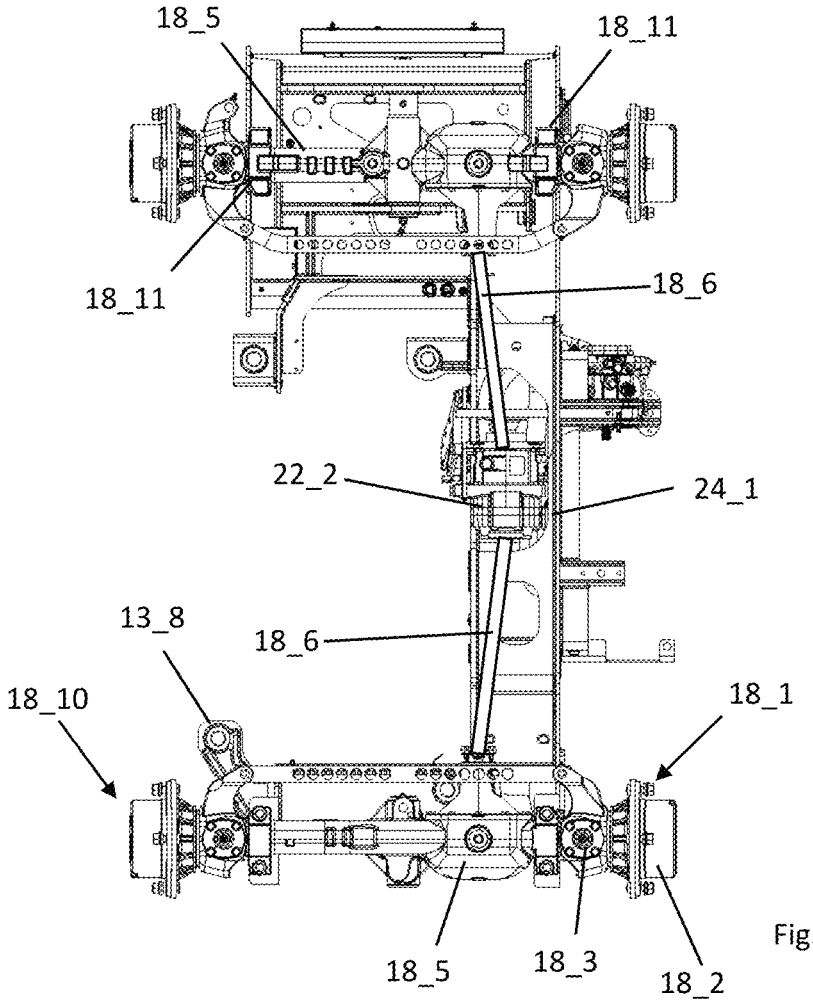
FIG. 12 shows an underside of the chassis and drive train.
Figure 13:
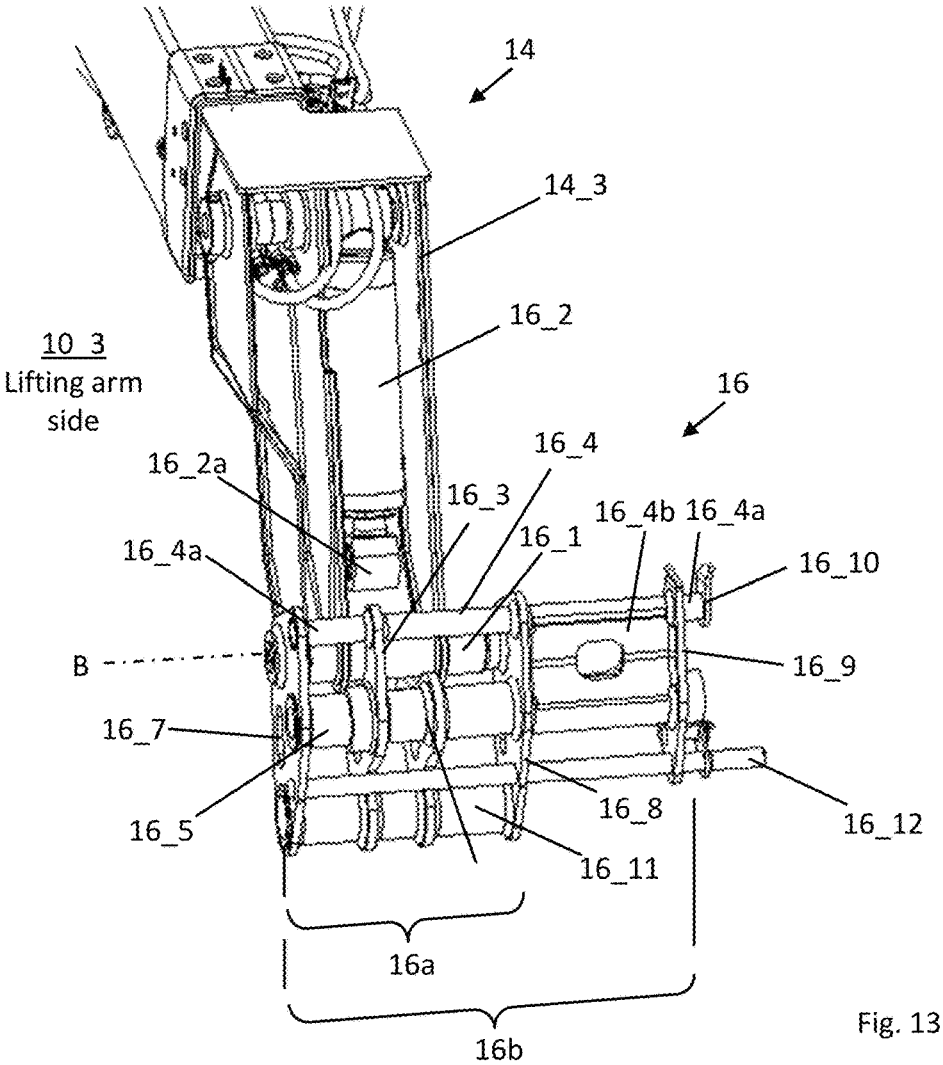
FIGS. 13 to 16 show, respectively, a front perspective, top-down, cab side side view and front view of a tool carrier of the machine according to the present disclosure.
Figure 14:
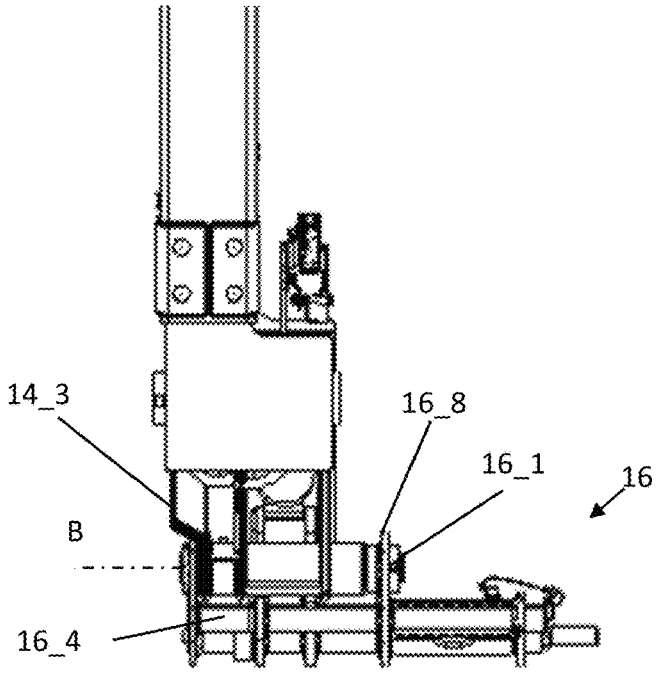

With reference to FIGS. 9 to 12, the wheel assembly 18_1 comprises a wheel hub 18_2 to which the wheel 18F is mounted in a conventional manner and a pivot connection 18_3 (which may be referred to as a steer swivel joint) about which the wheel 18F can turn relative to the chassis 24 when being steered. The wheel assembly is mounted to or an integral part of an axle 18_5 which is driveably connected to the hydrostatic motor 22_2 via a drive shaft 18_6. The arrangement shown in FIG. 12 is a four wheel drive machine having a similar arrangement for the front 18F and rear 18R wheels.

The steering mechanism (not shown) may be conventional and be configured to provide two wheel drive or four wheeled drive, the embodiment shown being capable of the latter. As such, each steerable wheel is provided with a wheel assembled having the pivot connection 18_3 about which the angle of the wheel 18F can be altered relative to the chassis 24 to effect steering of the machine.

In the embodiment shown, the outer wall 24_1 comprises a single plate member which terminates with a vertical drop-off to which is attached the wheel assembly mount pad 18_4. The mount pad 18_4 comprises a seat member to which the wheel assembly 18_1 or an associated axle 18_5 proximate to the wheel assembly 18_1 can be mounted. In the embodiment shown the mount pad 18_4 is elongate and arranged in a fore-aft orientation. A pair of attachment features in the form of bore holes are provided for receiving bolts 18_7 or threaded studs from the axle proximal to the mount. It will be appreciated that the specific means of attachment for the wheel assembly 18_1 and/or axle 18_5 may differ between embodiments with the form of the mount pad 18_4 and attachment features varying accordingly.

In order to maximize the lateral offset of the outer wall 24_1, the mount pad 18_4 extends inboard of the outer wall 24_1. A recess 18_8 may be provided in the outer surface of the outer wall 24_1 immediately behind a component of the wheel assembly, e.g. the pivot mount 18_3, to provide sufficient clearance for it to move. The recess 18_8 extends into the line of outer wall 24_1 and is aligned with the mount pad 18_4 to provide sufficient material thickness. The recess may be between 10 mm and 40 mm and receive a portion of the wheel assembly 18_1, thereby allowing the lateral offset of the wall 24_1 to be maximized. It will be appreciated that the recess 18_8 may be arranged to receive other parts of the wheel assembly 18_1.

As best seen in FIG. 10, the opposing side of the front transverse section 24*b* provides a wheel mount 18_10 having a similar mount pad 18_9 that extends outwards from the corresponding chassis member such that the bolt holes are accessible on the exterior of the chassis 24 and directly behind the corresponding wheel assembly 18_10. It will be appreciated that the lateral extent of the forward transverse section 24*b* can be less on the cab side of the machine 10 as this does not influence the position of the boom and the cab mount 13_8 can be provided on a cantilever member.

At the rear of the chassis 24, as shown from below in FIG. 12, the wheel mounts 18_11 are provided on the underside of the rear transverse section 24*c* of the chassis 24 on a suitably dimensioned plate and there is no requirement to provide a similar arrangement as the front lifting side wheel. As with the front mounting, the rear mounting may be provided with a suitable attachment such as one or more bolts or studs which extend through or from the chassis plate 24_1.

As noted above, the material handling machine 10 of the present disclosure may be provided with a drive train. As best seen in FIG. 12, the drive train may comprise a hydrostatic transmission 22, front and rear drive shafts 18_6, a front and rear axles 18_5. The front and rear axles 18_5 are mounted to the chassis 24 via mount pads, as described above, and are driveably connected to the respective wheel assembly to provide motive force to the wheels 18F, 18R. The hydrostatic motor 22_2 and drive shafts 18_6 are located beneath the base wall 24_3 and between the first and second side walls 24_1, 24_2 to provide protection.

It will be appreciated that the transmission system 22 described herein is generally conventional by way of the constituent components and the mode of operation. It will also be apparent that other forms of transmission and drive train may be employed in the material handling machine of the present disclosure.

With reference to FIGS. 1 and 13 to 16, the second distal end of the lifting arm 14 comprises the tool carrier 16 (which may be referred to as a tool carrier) to which a lifting implement may be mounted. The tool carrier 16 may be configured to carry a load of at least 1.3 tons, optionally 1.4 tons. The lifting implement may be any which finds useful employment with the material handling machine 10 and will typically include a shovel, forks, a grab, or a grapple, etc.

Generally, the tool carrier 16 comprises a coupling portion 16*a* which is attached to the drop section 14_3 of the lifting arm 14 and a tool attachment portion 16*b* which couples to a work tool 16_6. In the present disclosure, the coupling portion 16*a* and tool attachment portion 16*b* overlie one another in the width-wise direction with both extending from the outermost edge on the lifting arm side 10_3 of the tool carrier 16. The attachment portion 16*b* extends the full width with the coupling portion 16*a* extending part way. As such, the tool carrier 16 is supported by the coupling portion 16*a* on the lifting arm side 10_3 but extends across the center line of the tool carrier 16 and machine 10 to provide a central attachment for lifting implement (not shown).

The coupling portion 16*a* is centered to the lifting arm side 10_3 of the center, approximately 25% across from the outboard edge in the example shown, and comprises a pivot member 16_1 which is pivotally attached to lifting arm 14 and defines the tilt axis B. Rotation of the tool carrier 16 about tilt axis B is effected by a tilt actuator 16_2 which extends between the distal end of the lifting arm 14 and a tilt mount 16_3. The tilt mount 16_3 is provided vertically beneath the pivot member 16_1 in the present embodiment but may be provided above in some embodiments. As shown, the tilt actuator 16_2 maybe a hydraulic cylinder as well known in the art but other actuators may be employed.

The pivot member 16_1 comprises an elongate member, e.g. a round bar, which extends across the machine width. Due to the lateral position of the lifting arm 14 in relation to the body 12, a first end of the pivot member 16_1 may be located at or proximate to the lifting arm side edge of the tool carrier 16_1 and extend from that outer edge towards the midpoint over less than 60% of the width of the tool carrier 16, optionally for less than 55%, or less than 50%. As such, the pivot member 16_1 may be located fully on the lifting arm side 10_3 of the machine whilst providing a tool carrier 16 which is provided centrally on the machine 10. The center of the pivot member 16_1 and connection portion more generally may be located between 20% and 30% of the width away from the lifting arm side edge of the tool carrier 16. The connection between the pivoting member 16_1 and the lifting arm 16 may extend for less than half the width of the tool carrier, optionally for less than 40% of the width.

The tilt mount 16_3 may comprise any suitable attachment which can couple to the tilt actuator 16_2. In the embodiment shown, the tilt mount 16_3 is provided by a pair of plates or bosses which extend either side of a clevis mount 16_2*a* provided on the end of the rod of the cylinder. It will be appreciated that the cylinder rod is shown as being disconnected in FIG. 13 but would be pin mounted between the tilt mount plates in use.

The coupling portion 16*a* comprises a first lateral member 16_7 and an intermediate member 16_8 between which the pivot member 16_1 extends. As can be seen, the intermediate member 16_8 is located in a central region of the tool carrier 16 and may be referred to as a central member. In the embodiment shown, the intermediate member 16_8 is located more or less on the centerline of the tool carrier 16, and machine 10.

The first lateral member 16_7 may define the width of the tool carrier 16 at the lifting arm side 10_3 with the exception of one or more bosses which may project beyond for attaching the pivot member 16_1 or the like.

The attachment section 16*b* may comprise first and second tool attachment members 16_4 and 16_5 which are configured to detachably receive a work tool 16_6. The exact form of the attachment members 16_4, 16_5 may vary according to the work implements which are used.

Figure 15:
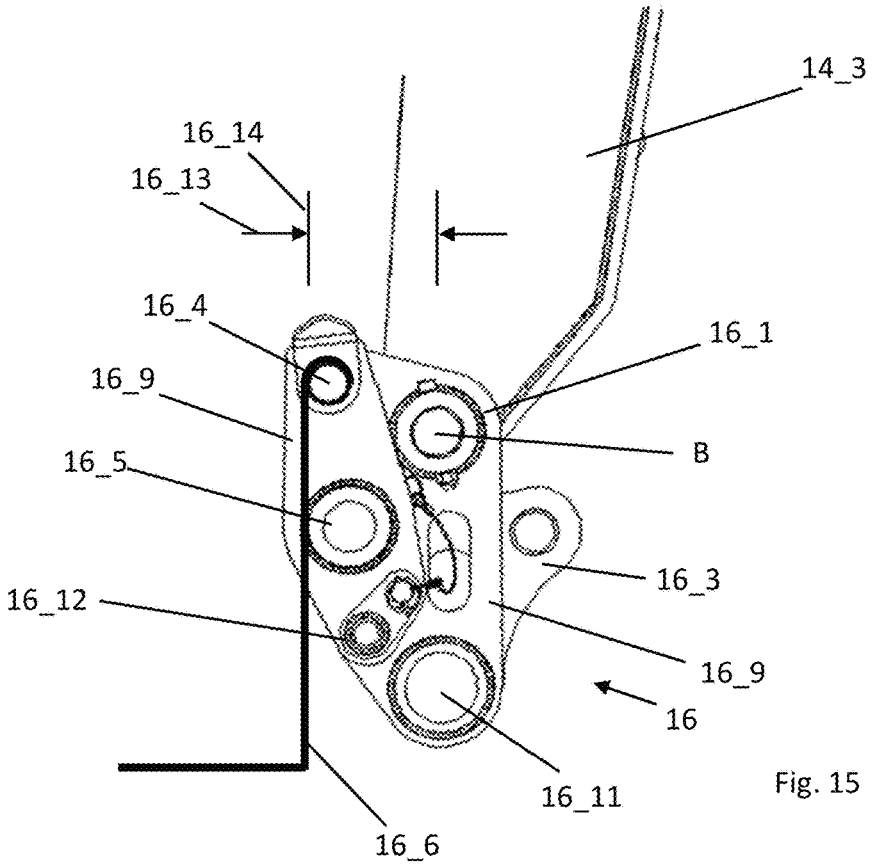
Figure 16:
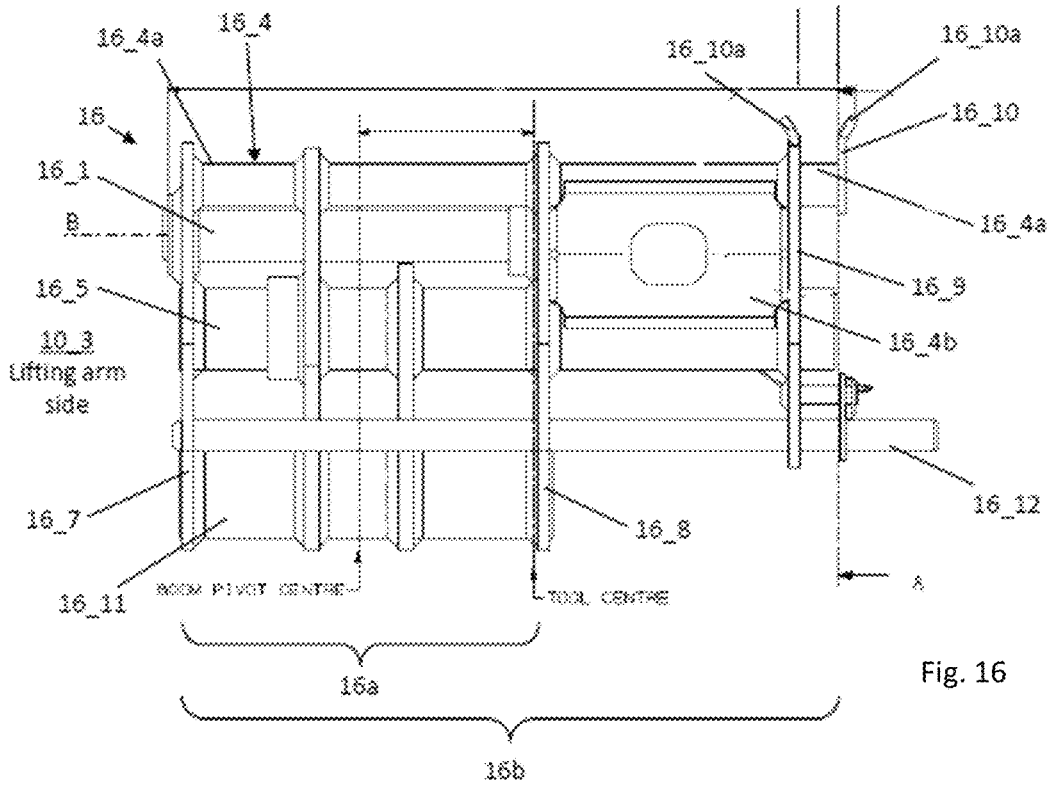

The first attachment member 16_4 may be referred to as attachment member or pick-up member, and the second attachment member 16_5 may be referred to as a reaction member or reaction bar. In use, a work tool 16_6 would comprise a pick-up point which would be located on the first attachment member 16_4 at a tool pick-up point 16_4*a*. The work tool 16_6 hangs from the first attachment member 16_4 and abuts the reaction member 16_5 to prevent rearward movement/rotation of the work tool 16_6 under its own weight or that of a load. The work tool 16_6 can be any tool known in the art including forks, a grapple, a shovel etc. FIG. 15 shows a side view of a simple schematic representation of a fork attachment, as well known in the art.

Specific attachment points 16_4*a* for the work tool 16_6 are laterally separated towards or at the outer edges of the tool carrier 16 to provide stability. In the example shown, the attachment member 16_4 and reaction member 16_5 extend across the full width of the tool carrier 16 and are attached to each other by lateral plates 16_7, 16_9 at either end to maintain their respective positions under load. In order to provide further strength and rigidity to the tool carrier 16, a gusset piece 16_4*b* is provided vertically between the attachment member 16_4 and reaction member 16_5 and horizontally between a second lateral member 16_9 and intermediate member 16_8.

The attachment portion 16*b* comprises the first lateral member 16_7 and an opposing end member at the cab side end 10_4 of the tool carrier 16. The opposing end member may be a structural member, such as a second lateral member 16_9 which is attached to both the attachment member 16_4 and reaction member 16_5, or a guide member 16_10 which defines an extreme of the attachment point 16_4*a*. In the described embodiment, the second lateral member 16_9 is provided inboard of the guide member 16_10 but this may differ in other embodiments. In some embodiments, the outermost guide member 16_10 may be omitted or incorporated with second lateral member 16_9.

Thus, in some embodiments, the attachment portion 16*b* may comprise at least two lateral members which extend vertically between the attachment member 16_4 and the reaction member 16_5. The first 10_7 and second lateral 16_9 members may be the outer most members in some embodiments. However, as shown, the attachment member 16_4 and reaction member 16_5 may extend beyond the first and/or second lateral members 16_7, 16_9 and comprise one or guide members 16_10 to limit the lateral extent thereof. As also shown, the attachment member 16_4 and reaction member 16_5 may be connected by and optionally pass through the intermediate member 16_8 which defines the coupling portion 16*a*.

In addition to the pivot member 16_1 and the tilt mount 16_3, the coupling portion 16*a* may comprise one or more additional members to provide additional strength and torsional rigidity. As an example of this, there can be seen an elongate member 16_11 located beneath reaction member 16_5. The further elongate member 16_10, which may be referred to as a brace or torsion member, extends across the coupling portion 16*a* between the first lateral member 16_7 and intermediate member 16_8 and, as shown, may also be attached to the tilt mounts 16_3 to provide additional support thereto.

An optional removable lock bar 16_12 which is configured to engage with and lock the tool in position is slidably and removably received through a plurality of the lateral members, as known in the art.

Referring to FIG. 15, there is shown a side view of the tool carrier 16 from which the arrangement of the pivot member 16_1, tilt mount 16_3, attachment member 16_4, reaction member 16_5 and brace member 16_11 of the coupling portion 16*a* are shown together with the intermediate member 16_8, second lateral member 16_9 and guide member 16_10.

The tool carrier 16 is shown in vertical orientation in which the front edges of the attachment member 16_4 and reaction member 16_5 are provided in a vertical plane. For the purposes of the present disclosure, this plane (whether vertical or not) may be referred to as an attachment plane 16_14 of the tool carrier 16 and may define the location of the tool 16_6 when attached.

It will be noted that the attachment plane 16_14 is located forwards of the pivot axis B by a horizontal offset which may be referred to as an attachment plane offset 16_13. An advantage of the tool carrier 16 of the present disclosure is that the separation 16_3 between the pivot axis B and the attachment plane 16_4 is smaller than conventional tool carriers which increases the mechanical advantage of tilt actuator 16_2. More specifically, the attachment plane offset 16_14 may be below 200 mm, optionally below 160 mm, optionally below 130 mm.

The reduction in this fore-aft dimension of the tool carrier 16 is made possible, at least in part, by the vertical separation between the reaction member 16_5 and pivot member 16_1 thereby allowing the reaction member 16_5 to move rearwards towards the pivot member 16_1. Hence, there is provided a tool carrier 16 in which first and second attachment members 16_4, 16_5 are provided vertically above and below a pivot member. Further, an aft edge of either of the first or second attachment members 16_4 and 16_5 axially overlap the pivot member 16_1 when the attachment plane is vertical.

As can be seen, the torsion member 16_11 is located directly below the pivot member 16_1 such that their centers lie in plane which is substantially parallel to the attachment plane.

The width of the tool carrier 16 may be defined by the laterally outermost members which define and limit the location of the work tool 16_6. In the example shown, these members are the first lateral member 16_7 and the guide member 16_10. The width of the tool carrier in the present disclosure may be less than 900 mm, optionally less than 700 mm, optionally less than 650 mm. As such, the tool carrier 16 may comprise work tool pick-up points having a separation which is less than 900 mm, optionally less than 700 mm, optionally less than 650 mm.

The tool carrier 16 may comprise one or more guide members 16_10*a* to aid location of a tool on the attachment points. The guide members 16_10*a* may comprise funnel shaped members which comprise a flared portion provided at the tool receiving end of any of the members which are positioned adjacent to the attachment points 16_4*a*. The guide members 16_10*a* may be inclined outwards with respect to the attachment point 16_4*a*. Thus, in some embodiments, the laterally outermost members 16_7 and 16_10 of the tool carrier 16 may be provided with the funnel members to allow for easier alignment when attaching a tool 16_6.

In the embodiment shown in FIGS. 13 to 16, the guide members 16_4*a* are provided on the two members which flank the cab side attachment point 16_4*a*. In doing so, there is provided a funnel shaped guide at a single attachment point in view of the operator cab such that an operator can correctly judge the lateral position of the work tool without the need to see the lifting arm side of the tool carrier 16. As such, the alignment of a tool may be made easier.

The cab side attachment point 16_4*a* may comprise a length of 60 mm or less, optionally, 40 mm or less. The angle of the guide members 16_10*a* may be less than 90 degrees, optionally less than 80 degrees, optionally 70 degrees with respect to vertical and away from the attachment point 16_10*a*.

With reference to FIG. 1*e*, the rear housing 17 may comprise attachment points 36_1 for removably attaching a safety strut 36. Safety struts 36 are well known in the art and generally comprise a rigid cylindrical sleeve which is received around the rod of a hydraulic cylinder to prevent retraction when fully extended, thereby safely locking it out. Safety struts are typically fitted to a working or lifting arm hydraulic cylinder, e.g. lift actuator 14_4, when the when the machine 10 is left unattended or during maintenance or the like.

More specifically, the safety strut 36 comprises an elongate cylindrical sleeve having a length which corresponds to the exposed length of the rod when the hydraulic cylinder 14_4 is in an extended configuration. The diameter of the sleeve is less than the diameter of the cylinder rod-side cap and an opposing shoulder of the rod mount so that, once fitted around the rod, the sleeve is compressed between the cylinder cap and rod mount to maintain separation. The sleeve 36 comprises a full-length slot so that it can be located around the rod.

To fit the safety sleeve, a hydraulic cylinder is typically extended to full extension, for example, by raising the working or lifting arm, prior to the operator (or some other person) fitting the sleeve over the rod. Once fitted, the hydraulic cylinder is retracted until the rod mount urges against the sleeve and, in turn, the cylinder head. Once contact is made, the hydraulic pressure can be removed with further retraction of the rod being prevented by the sleeve 36.

The safety sleeve 36 is fitted to the rear of the machine 10 via a pair of attachment points 36_1 which may take any suitable form. In the described embodiment, the attachment points 36_1 are a pair of anti-luce latches (which may be referred to as drop catches or drop catch latches) each of which comprising an elongate stud extending perpendicularly from the rear compartment 17 and a drop bar which is longitudinally aligned with the stud for insertion through a corresponding aperture in the sleeve 36. Once inserted, the drop bars are lifted through rotation by an operator allowing them to drop under gravity so as to fall across the sleeve aperture thereby preventing withdrawal and removal of the safety sleeve in place. In order to remove the safety sleeve 36, the drop bars are lifted and rotated so as to be longitudinally re-aligned. Anti-luce latches are well known in the art.

Providing the safety strut 36 on the rear of the machine 10 not only provides a convenient location for stowage of the sleeve 36, but the weight of the sleeve 36 can add to the counterweight of the machine 10. This can help add stability to the machine 10.

With reference to FIGS. 17 to 27 there is shown a material handling machine 10' in the form of a telehandler according to a second embodiment. Features shared with the material handling machine 10 of the first embodiment have common reference numerals. Unless stated otherwise, the machine 10' of the second embodiment may share any of the same features as the material handling machine 10 of the first embodiment, and vice versa.

The material handling machine 10' includes a prime mover 20' in the form of an electric motor 20'.

Figure 17:
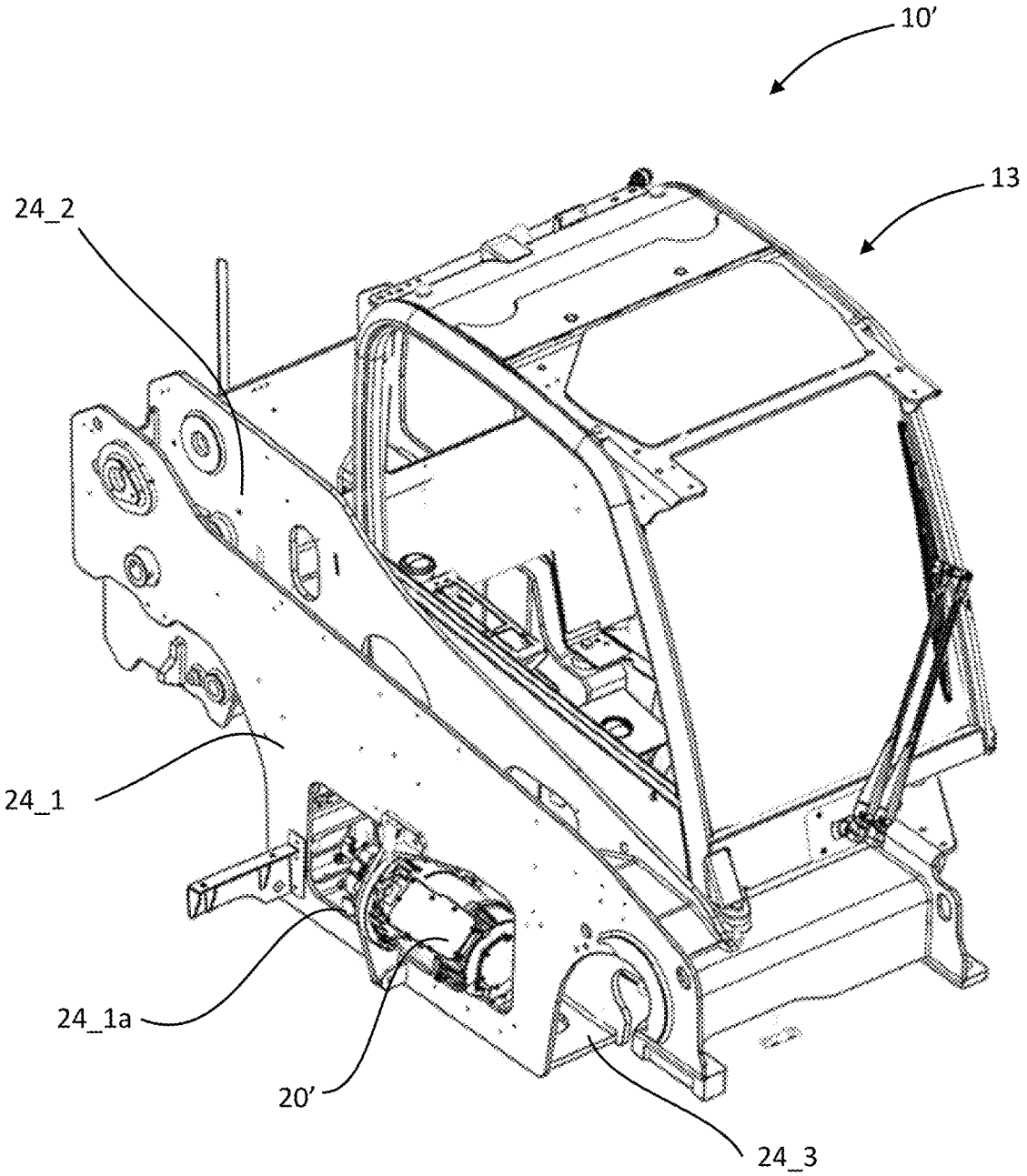
FIG. 17 is an isometric view of a chassis and cab of the machine according to the present disclosure.
Figure 18:
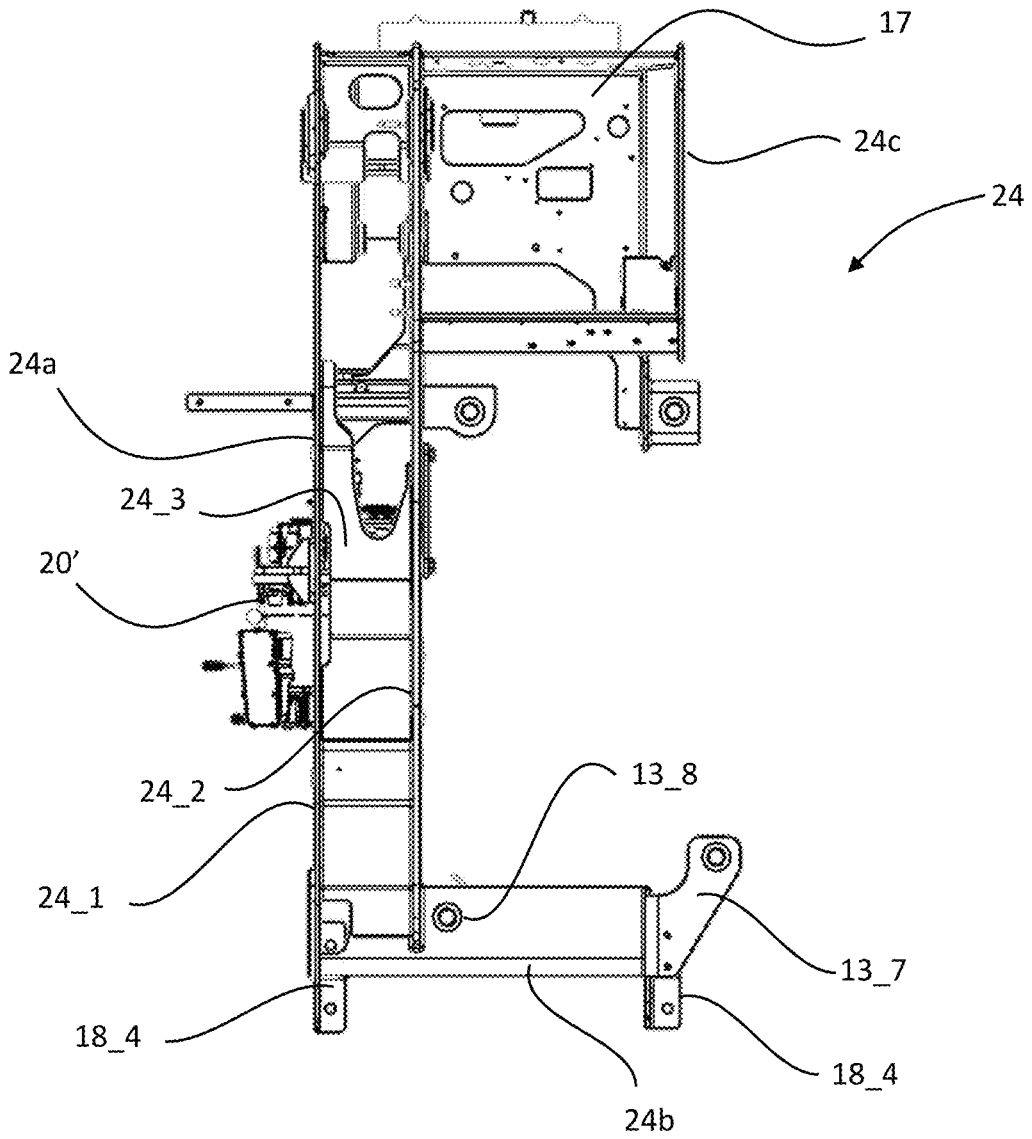
FIG. 18 is a plan view of the chassis of the machine according to the present disclosure.

As can be seen best in FIG. 17, the outer wall 24_1 of the chassis main body portion 24*a* comprises a large aperture 24_1*a* through which portions of the prime mover 20' extend. As such, the prime mover 20' may be moved towards the centerline 30 of the machine 10'.

The main body portion 24*a* of this embodiment comprises an outer wall 24_1, an inner wall 24_2, a base wall 24_3 and a base plate 24_4 (or deck plates, as the base wall and the base plate may be referred to), which extends therebetween.

Figure 19:
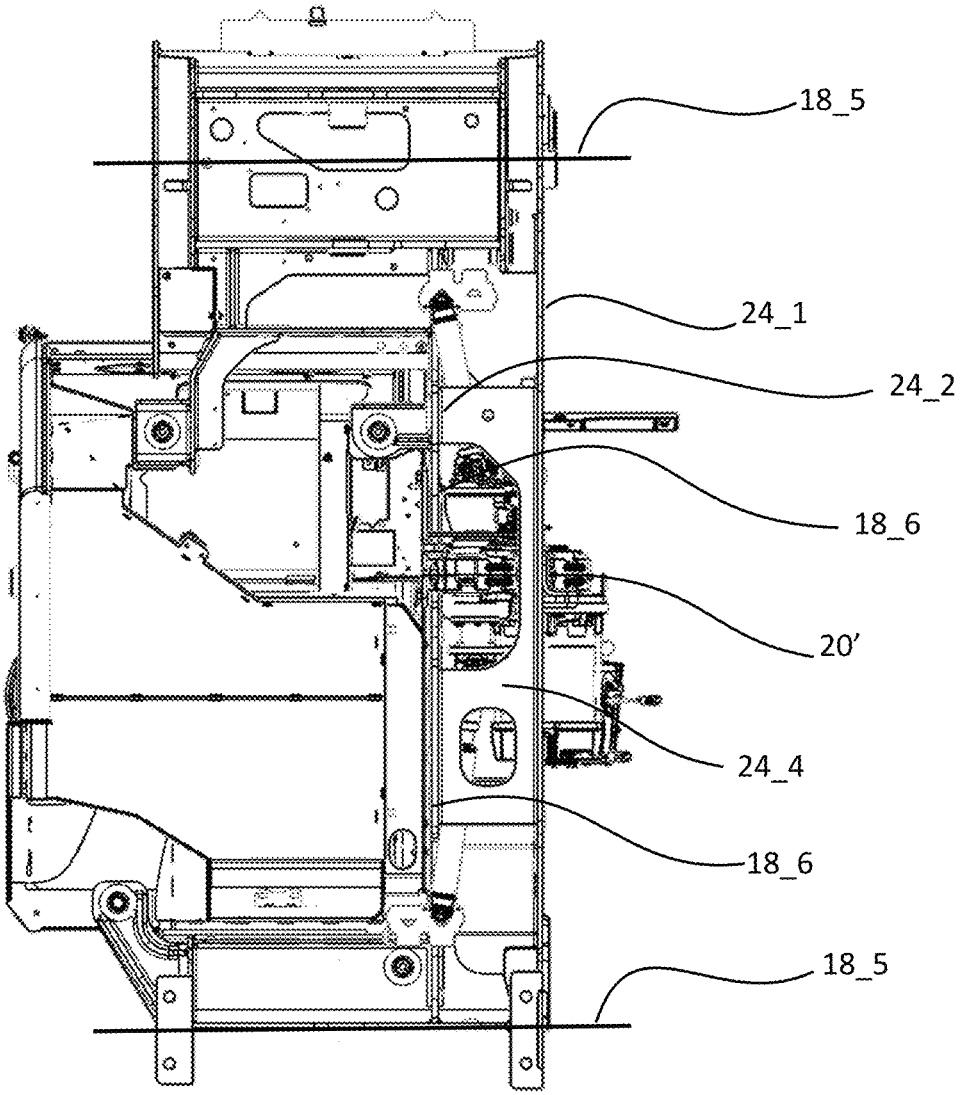
FIG. 19 is an underside plan view of the chassis and cab of the machine according to the present disclosure.

As shown in FIG. 19, this embodiment of the present disclosure comprises a base plate 24_4 which extends between the lifting arm housing outer wall 24_1 and lifting arm housing inner wall 24_2. The base plate 24_4 may comprise a plate-like member which spans laterally between the outer and inner walls 24_1, 24_2, and longitudinally across the aperture 24_1*a* so as to connect the opposing ends thereof.

The base plate 24_4 may extend across the aperture 24_1*a* proximal a lower edge of the chassis outer wall 24_1 and aperture 24_1*a* and comprise one or more cut-outs to receive the parts of the prime mover 20 which extend through the aperture 24_1*a* into the lifting arm housing.

Advantageously, the base wall 24_3 requires less material to be removed in order to accommodate the drive assembly unit of this embodiment than is required to be removed for some alternative prime mover, thus improving structural performance.

In addition to the base wall 24_3 and the base plate 24_4, the first 24_1 and second 24_2 sidewalls may be connected by a plurality of connecting portions provided by the front 24*a* and rear 24*c* transverse sections and separate struts and box sections.

Figure 20:
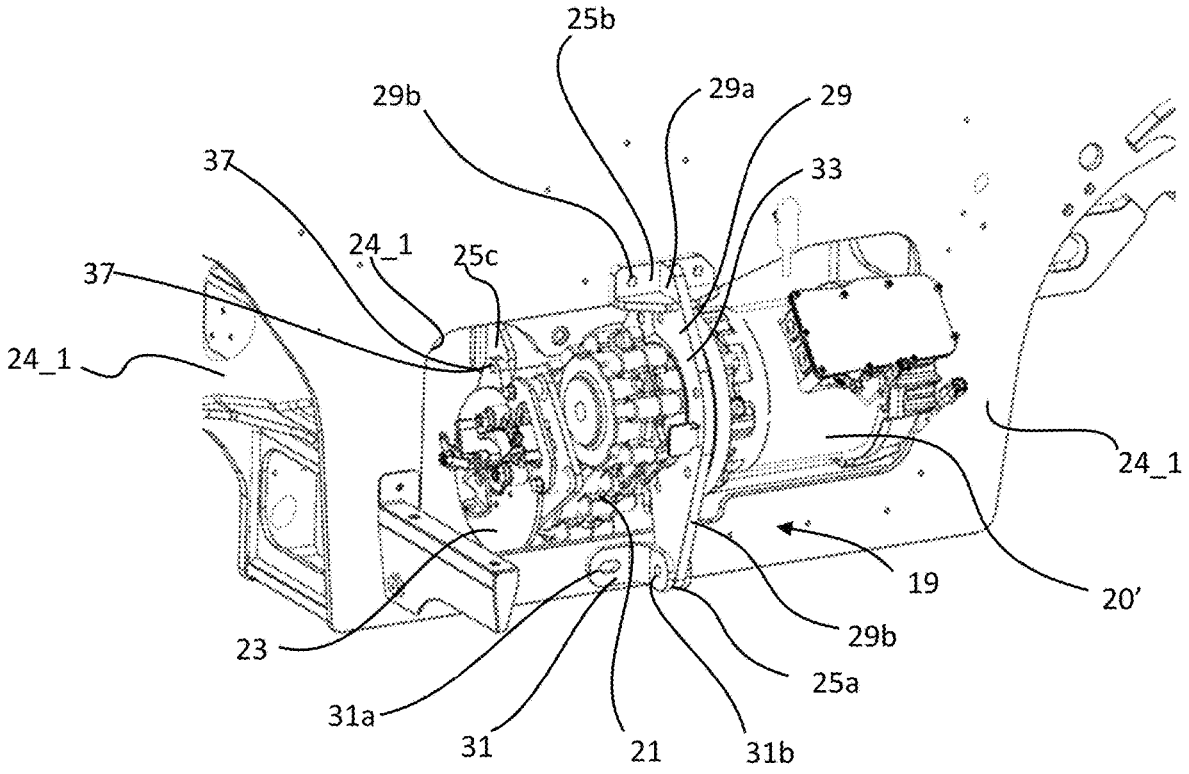
FIG. 20 is a partial isometric view of a first sidewall of a lifting arm housing with portions of a drive assembly extending therethrough.
Figure 21:
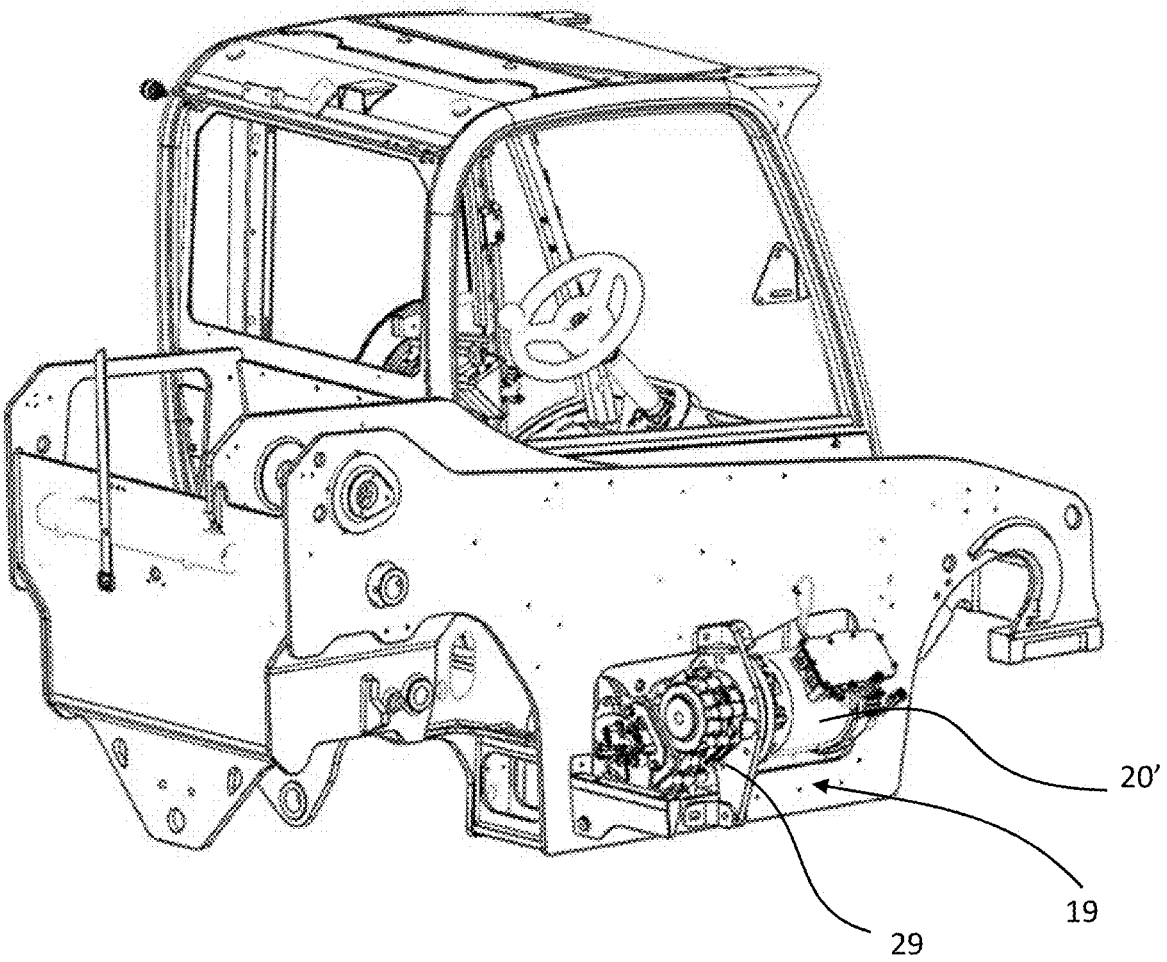
FIG. 21 is an isometric view of the chassis and cab of the machine according to the present disclosure.
Figure 22:
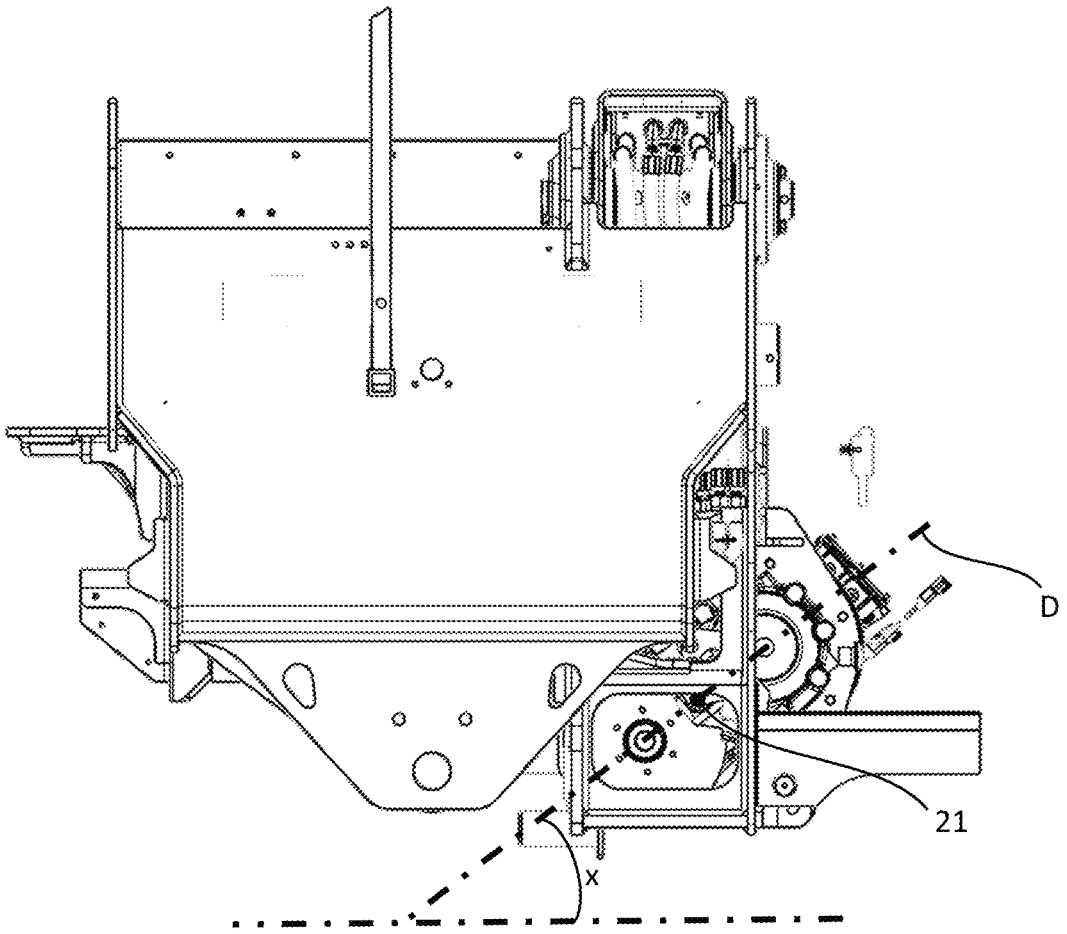
FIG. 22 is a rear view of the chassis of the machine according to the present disclosure, with the drive assembly.

In this embodiment, as shown in FIGS. 20 and 21, the machine 10' has a drive assembly unit 19 which includes the prime mover 20', in this embodiment the electric motor 20'. The drive assembly unit 19 further includes a "dropbox" or gear train 21 by which power is transferred from the electric motor 20' to the ground engaging structure 18. In this embodiment, the gear train 21 is a reduction gear train. In alternative embodiments, the gear train is some other suitable type of gear train. Power is transferred via the gear train 21 to the drive shaft or shafts 18_6. In this embodiment, there are two drive shafts 18_6, such that power is transferred from the electric motor 20' to drive both fore and aft axles 18_5. The gear train 21 includes a series of at least two gears having parallel axes of rotation with respect to one another, and with respect to the drive shaft(s) 18_5.

Using a single electric motor 20' to drive both fore and aft axles 18_5 advantageously minimizes the number of components required, so minimizing complexity, e.g. of software as well as components, and expense and enabling the machine 10' to be compact.

The drive assembly unit 19 also includes a brake assembly 23 mounted to the gear train 21. In this embodiment, the brake assembly is a disc brake assembly 23. In alternative embodiments, the brake assembly is a drum brake assembly.

In this embodiment, the electric motor 20' extends through the aperture 24-1*a*, together with the gear train 21. Advantageously, the drive assembly unit 19 extending through the aperture 24-1*a* enables the machine to be compact, yet to have a larger cab, as described above.

The drive assembly unit 19 is in this embodiment assembled as a single unit prior to installation on the machine 10'. During installation, the drive assembly unit is mounted to the chassis 24 as a unit. As shown in FIG. 20, the drive assembly unit 19 is mounted to the chassis 24 at three mounting points 25*a*, 25*b*, 25*c*. In alternative embodiments, the drive assembly unit is mounted to the chassis at fewer than three or more than three mounting points.

The drive assembly unit 19 is in this embodiment mounted to the first and second sidewalls 24_1, 24_2. The first mounting point 25*a* is at an outboard side of the first sidewall 24_1. The second mounting point 25*b* is at an outboard side of the first sidewall 24_1. In this embodiment, the aperture 24_1*a* is fully enclosed by the first sidewall 24_1*a*. The first mounting point 25*a* is positioned below the aperture 24_1*a* through which the drive assembly unit 19 extends. The second mounting point 25*b* is located above the aperture 24_1*a*.

In this embodiment, the drive assembly unit 19 includes a bracket 29 to which the electric motor 20' and the gear train 21 are secured. The bracket 29 includes in this embodiment a body in the form of an elongate plate 33 oriented substantially vertically in relation to the machine 10'.

The bracket 29 has a first end 29*a* by which the bracket is secured to the first mounting point 25*a*. In this embodiment, the bracket first end 29*a* includes an L-shaped bracket 31 pivotably secured to the body 33 at a pivot point 31*b*, e.g. by a suitable fastener. The bracket 31 defines an aperture 31*a* for securing the bracket 31 and thus the bracket 29 to the first sidewall 24_1. In this embodiment, the aperture 31*a* is a slot, to allow for tolerance.

The bracket 29 has a second end 29*b* which defines apertures 29*b* by which the bracket second end 29*b* is secured to the first sidewall 24_1 at the second mounting point 25*b*. The second mounting point 25*b* includes apertures defined by the first sidewall 24_1 that correspond to the apertures 29*b*. Fasteners (not shown) are used to secure the bracket first end 29*a* to the first sidewall 24_1.

In this embodiment, the chassis 24 includes a bracket secured to the second sidewall 24_2 and extending perpendicularly therefrom to provide the third mounting point 25*c*. The drive assembly unit 19 includes a corresponding bracket 37 for securing to the third mounting point bracket 25*c*. Both brackets define corresponding apertures through which a fastener (not shown) extends to secure the drive assembly unit 19 at the third mounting point 25*c*. In this embodiment, one or both apertures 37*a* are in the form of slots in order to allow for tolerance.

Shared mounting points and brackets are used where possible in order to minimize weight and reduce the number of components.

Upon installation of the drive assembly unit 19 on the machine 10, the drive assembly unit 19 is lowered, e.g. using a crane and sling, into position in an orientation such that a longitudinal axis D (see FIG. 22) of the gear train 21 is at a first angle. In this embodiment, the first angle is substantially zero, i.e. the axis D is substantially horizontal in relation to the machine body. In an alternative embodiment, the first angle is some other suitable angle for installation of the drive assembly unit. The drive assembly unit 19 is positioned such that the bracket 31 can be secured to the sidewall 24_1 at the first mounting point 25*a*.

The drive assembly unit 19 is then pivoted about the pivot point 31*b* until the axis D is at a second angle x, where the second end 29*b* of the bracket 29 is in contact with the first sidewall 24_1 at the second mounting point 25*b*. In this embodiment, the second angle x is 40° to the horizontal in relation to the machine body. In alternative embodiments, the second angle is some other suitable angle, e.g. in the range 30° to 50°.

The second end 29*b* is secured to the first sidewall 24_1 at the second mounting point 25*b*. The bracket 37 is then secured to at the second sidewall 24_2 at the third mounting point 25*c*. Alternatively, the drive assembly 19 is mounted to the third mounting point and then to the second mounting point. Alternatively, the first, pivotable, mounting point is above the aperture 24_1*a*, i.e. the drive assembly is initially mounted to a point above the aperture 24_1*a* before pivoting takes place.

Advantageously, the drive assembly unit 19 being pivotable about the first mounting point 25*a* allows installation of the drive assembly unit 19 into a compact space. The drive assembly unit 19 is pivoted into a position where the longitudinal axis D is suitable oriented without the need for expensive manipulating equipment.

In this embodiment, substantially 40% of the first electric motor 20' extends to the cab side of the first sidewall 24_1. In alternative embodiments, 30% to 50% of the first electric motor extends to the cab side of the first sidewall 24_1. In alternative embodiments, 20% to 60% of the first electric motor extends to the cab side of the first sidewall 24_1.

The present disclosure provides a material handling machine, e.g. a compact telehandler, having a large operator cab for improved operator comfort and safety. The compact telehandler may be trailer towable, however, this is not a limitation and the telehandler may have a weight which is above 2950 kg in some examples. The compact telehandler may comprise a side mounted engine which extends through a sidewall of a lifting arm housing and under the lift arm. However, this is not a limitation and the engine may be rear-mounted in some examples.

The one or more embodiments are described above by way of example only and it will be appreciated that the variations are possible without departing from the scope of protection afforded by the appended claims.

The invention claimed is:

1. A material handling machine having a front and a rear defined by the principal direction of travel, and a cab side and a lifting arm side on either side of a fore-aft centerline, the machine comprising:

a body mounted on a ground engaging structure which includes a front pair of wheels and a rear pair of wheels, at least one of the pairs of wheels being movable relative to the body to effect steering of the machine;

a single telescopic lifting arm pivotally mounted towards an aft end of the body and on the lifting arm side of the centerline, the lifting arm being located within a lifting arm housing, the lifting arm housing being fully located on the lifting arm side of the centerline and comprising first and second sidewalls and a base wall;

an operator cab mounted on the cab side of the body and adjacent to the lifting arm housing, the operator cab comprising a seat and one or more control devices for controlling the ground engaging structure and/or an operation of the lifting arm, wherein the operator cab extends from the cab side of the machine across a width of the machine, wherein the operator cab further comprises a first cab sidewall located on the cab side of the machine and a second cab sidewall located on the lifting arm side of the machine such that the cab extends over at least half of the width of the machine; and a prime mover fully located on the lifting arm side of the machine opposite the operator cab, wherein the prime mover extends through an aperture in the first wall of lifting arm housing and under the lifting arm.

2. The machine of claim 1, wherein the base wall of the lifting arm housing extends around the prime mover.

3. The machine of claim 2, wherein the base wall comprises a plate member, the plate member comprising one or more recesses into which the prime mover extends within the lifting arm housing.

4. The machine of claim 3, wherein the prime mover is located axially between the front and back wheels on the lifting arm side.

5. The machine of claim 2, wherein the base wall extends from an aft location of the prime mover on the first sidewall of the lifting arm housing to a fore location on the second sidewall of the lifting arm housing.

6. The machine of claim 5, wherein the fore location is forward of the prime mover.

7. The machine of claim 1 wherein the aperture through which the prime mover extends comprises a lobed profile in which a peripheral edge of the aperture comprises a plurality of lobes in which parts of the prime mover are received.

8. The machine of claim 7, wherein the base wall attaches to the first sidewall of the lifting arm housing on a projection which extends radially inwards towards a central region of the aperture and which defines a first lobe and a second lobe of the plurality of lobes.

9. The machine of claim 8, wherein the projection extends forward from an aft portion of the aperture.

10. The machine of claim 1, further comprising a lift actuator, wherein the base wall comprises a recess in which the lift actuator resides when the lifting arm is in a lowered non-working position.

11. The machine of claim 10, wherein the base wall comprises a y-shape when viewed in plan.

12. The machine of claim 1, further comprising a hydrostatic drive, wherein a hydrostatic motor of the hydrostatic drive is located beneath the base wall.

13. The machine of claim 1, wherein the base wall comprises a first elevated section and a second elevated section, the first and second elevated sections being located at different heights wherein, optionally, the second elevated section is provided fore of the first elevated section and is lower.

14. The machine of claim 13 further comprising a hydrostatic drive, wherein a hydrostatic motor of the hydrostatic drive is located beneath the base wall, wherein the hydrostatic motor is located under the first elevated section.

15. The machine of claim 1, wherein the prime mover is mounted to the body via a plurality of engine mounts, wherein at least one engine mount is provided outboard of the first sidewall of the lifting arm housing, and at least one engine mount is provided inboard of the first sidewall; optionally wherein the prime mover is pivotable in relation to at least one of said engine mounts; optionally wherein the prime mover is pivotable in relation to an engine mount provided outboard of the first sidewall of the lifting arm housing.

16. The machine of claim 1, wherein the prime mover is an electric motor.

17. The machine of claim 1, wherein the operator cab further comprises a first cab sidewall and a second cab sidewall, the first and second cab sidewalls defining an internal width of the operator cab, wherein the internal width is at least 700 mm.

18. The machine of claim 1, wherein the operating weight of the machine is less than 2950 kg.

19. The machine of claim 1, wherein the first sidewall defines an external lateral extent of the machine on the cab side, and the second sidewall is located on an opposite side of a machine centerline such that the cab extends over half of the width of the machine.

20. The machine of claim 1, wherein the lifting arm comprises a tool carrier mounted to a distal end thereof, the tool carrier comprising a coupling portion connected to the lifting arm and an attachment portion for receiving a work tool, the coupling portion comprising a pivot member pivotally attached to lifting arm, the pivot member defining a pivot axis about which the tool carrier can pivot relative to the lifting arm; and a tilt mount attached to a tilt actuator of the lifting arm wherein the tilt actuator is configured to rotate the tool carrier about the pivot axis; optionally wherein the pivot member extends for less than 55% of the width of the tool carrier.

* * * * *